US008906588B2

(12) United States Patent
Shinya et al.

(10) Patent No.: US 8,906,588 B2
(45) Date of Patent: Dec. 9, 2014

(54) ELECTROSTATIC CHARGE IMAGE DEVELOPING TONER, METHOD OF MANUFACTURING ELECTROSTATIC CHARGE IMAGE DEVELOPING TONER, ELECTROSTATIC CHARGE IMAGE DEVELOPER, TONER CARTRIDGE, PROCESS CARTRIDGE, AND IMAGE FORMING METHOD

(71) Applicant: Fuji Xerox Co., Ltd., Tokyo (JP)

(72) Inventors: Tomohiro Shinya, Kanagawa (JP); Shinpei Takagi, Kanagawa (JP); Soichiro Kitagawa, Kanagawa (JP); Shinya Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/911,431

(22) Filed: Jun. 6, 2013

(65) Prior Publication Data

US 2014/0113227 A1 Apr. 24, 2014

(30) Foreign Application Priority Data

Oct. 22, 2012 (JP) ..... 2012-233000

(51) Int. Cl.

| | |
|---|---|
| ***G03G 9/093*** | (2006.01) |
| ***G03G 13/08*** | (2006.01) |
| ***G03G 9/08*** | (2006.01) |
| ***G03G 9/113*** | (2006.01) |

(52) U.S. Cl.

CPC ..... *G03G 9/09321* (2013.01); *G03G 13/08* (2013.01); *G03G 9/0806* (2013.01); *G03G 9/08* (2013.01); *G03G 9/113* (2013.01)

USPC ..... 430/110.2; 430/109.3; 430/109.4

(58) Field of Classification Search

USPC ..... 430/110.2, 109.3, 109.4

See application file for complete search history.

(56) References Cited

U.S. PATENT DOCUMENTS

| | | | | |
|---|---|---|---|---|
| 2005/0175922 | A1* | 8/2005 | Fujino et al. | 430/110.2 |
| 2006/0269861 | A1 | 11/2006 | Hirano et al. | |
| 2008/0063970 | A1* | 3/2008 | Kikawa et al. | 430/110.2 |
| 2009/0011357 | A1* | 1/2009 | Kawase et al. | 430/110.1 |
| 2009/0220883 | A1 | 9/2009 | Sugiura | |
| 2010/0142999 | A1* | 6/2010 | Kubo | 399/252 |

FOREIGN PATENT DOCUMENTS

| | | |
|---|---|---|
| JP | A-2007-4127 | 1/2007 |
| JP | A-2010-44354 | 2/2010 |
| JP | A-2011-99954 | 5/2011 |
| JP | A-2011-185973 | 9/2011 |

* cited by examiner

*Primary Examiner* — Hoa V Le
(74) *Attorney, Agent, or Firm* — Oliff PLC

(57) ABSTRACT

An electrostatic charge image developing toner is provided which includes a core particle that contains an amorphous polyester resin and a colorant; and a shell layer that covers the core particle and contains a polystyrene resin, wherein a softening temperature Ma of the shell layer and a softening temperature Mb of the core particle satisfy a relationship of 10° C.≤Ma-Mb≤45° C.

13 Claims, 5 Drawing Sheets

ELECTROSTATIC CHARGE IMAGE DEVELOPING TONER, METHOD OF MANUFACTURING ELECTROSTATIC CHARGE IMAGE DEVELOPING TONER, ELECTROSTATIC CHARGE IMAGE DEVELOPER, TONER CARTRIDGE, PROCESS CARTRIDGE, AND IMAGE FORMING METHOD

CROSS-REFERENCE TO RELATED APPLICATIONS

This application is based on and claims priority under 35 USC 119 from Japanese Patent Application No. 2012-233000 filed Oct. 22, 2012.

BACKGROUND

1. Technical Field

The present invention relates to an electrostatic charge image developing toner, a method of manufacturing an electrostatic charge image developing toner, an electrostatic charge image developer, a toner cartridge, a process cartridge, and an image forming method.

2. Related Art

A method of visualizing image information via a latent image (electrostatic charge image), such as an electrophotographic method, has been widely used in various fields. In the electrophotographic method, an electrostatic charge image on the surface of an electrophotographic photoreceptor (electrostatic charge image holding member, which may also be referred to as a "photoreceptor") is developed with an electrostatic charge image developing toner through the use of a charging step and an exposing step (electrostatic charge image forming step) and the electrostatic charge image is then visualized through the use of a transfer step, a fixing step, and the like.

SUMMARY

According to an aspect of the invention, there is provided an electrostatic charge image developing toner including: a core particle that contains an amorphous polyester resin and a colorant; and a shell layer that covers the core particle and contains a polystyrene resin, wherein a softening temperature Ma of the shell layer and a softening temperature Mb of the core particle satisfy a relationship of 10° C.≤Ma-Mb≤45° C.

BRIEF DESCRIPTION OF THE DRAWINGS

Exemplary embodiments of the invention will be described in detail based on the following figures, wherein.

DETAILED DESCRIPTION

Figure 1:
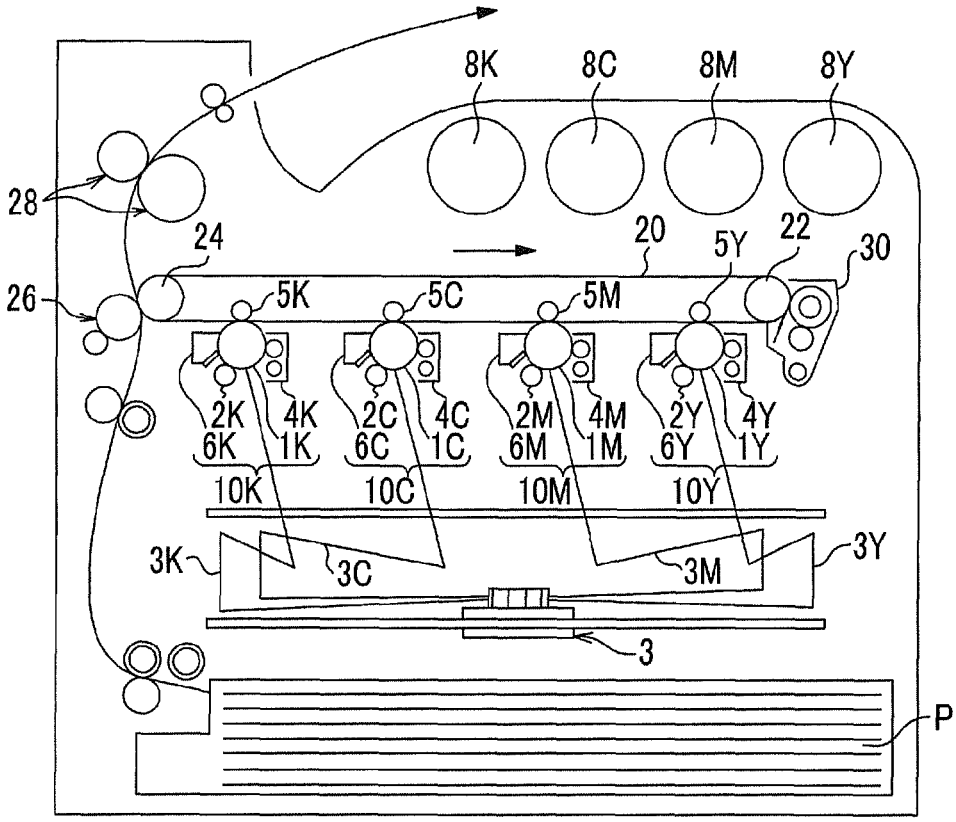
FIG. 1 is a diagram schematically illustrating an example of a configuration of an image forming apparatus according to an exemplary embodiment of the invention.

Hereinafter, an electrostatic charge image developing toner, a method of manufacturing the electrostatic charge image developing toner, an electrostatic charge image developer, a toner cartridge, a process cartridge, and an image forming method according to exemplary embodiments of the invention will be described in detail.

Electrostatic Charge Image Developing Toner and Manufacturing Method Thereof

An electrostatic charge image developing toner (hereinafter, also referred to as a toner according to this exemplary embodiment) according to this exemplary embodiment includes a core particle that contains an amorphous polyester resin and a colorant and a shell layer that covers the core particle and contains a polystyrene resin, and a softening temperature Ma of the shell layer and a softening temperature Mb of the core particle satisfy a relationship of 10° C.≤Ma-Mb≤45° C.

In the surface of the toner, a fluidizing agent, an abrasive, and a transfer aid, more specifically, inorganic particles of silica, titania, cerium oxide, and the like are generally used as external additives. In order to effectively maintaining the functions of the inorganic particles, the surface of the toner should have a certain level of hardness. When the hardness of the surface of the toner is low, the fluidizing agent is mainly embedded in the surface of the toner by agitation in a developing device or the like and thus a difference in charging property between toner particles is caused. Accordingly, toner particles not satisfying a necessary amount of charge are formed, thereby causing a problem in that an image density is lowered, or the like.

On the other hand, from necessity for recent energy saving, it is necessary to lower the fixing temperature of a toner, but the rise in hardness of the surface of the toner causes a rise in fixing temperature. When the hardness of the surface of the toner is raised, the melting of the toner at the time of fixation degrades and migration of the release agent from the inside of the toner is prevented, thereby not responding to the request for low-temperature fixability in some cases. In addition, when the hardness of the surface of the toner is higher than that of the inside of the toner, it means that a temperature-dependent volume change differs depending on the materials. Accordingly, a stress is generated in the toner due to the difference in volume change in the step of manufacturing the toner or in the step of dissipating heat generated by the agitation in the developing device and the material on the surface is peeled off due to the increase in the stress, thereby causing aggregation or fogging of toner particles in some cases.

In this exemplary embodiment, migration of a release agent is not hindered and embedment of the fluidizing agent is suppressed to a certain extent by defining a difference between the softening temperature of the surface of the toner (that is, shell layer) and the softening temperature of the inside of the toner (that is, core particle), and particularly the peeling-off of the surface is suppressed, thereby preventing occurrence of chipping and breaking of the toner.

Since the softening temperature Ma of the shell layer and the softening temperature Mb of the core particle satisfy the relationship of 10° C.≤Ma-Mb≤45° C., it is possible to suppress peeling-off of a material on the surface of the toner due to a stress generated in the step of manufacturing the toner or in the step of dissipating heat generated by the agitation in the developing device and also to suppress embedment of the fluidizing agent in the surface of the toner.

When Ma-Mb is less than 10° C., it may be difficult to suppress embedment of the fluidizing agent in the surface of the toner. When Ma-Mb is more than 45° C., it may not be possible to suppress peeling-off of the material from the surface of the toner due to the generated stress.

It is more preferable that Ma-Mb be in a range of 15° C.≤Ma-Mb≤35° C., because the above-mentioned effect may be more easily achieved.

In this exemplary embodiment, the softening temperature Ma of the shell layer and the softening temperature Mb of the core particle are measured using a scanning probe microscope (Nonoscope IIIa+D3100, made by Digital Instruments Inc.) and a nano-TA (nano-TA, made by Anasys Instruments Inc).

The softening temperature Ma of the shell layer is observed by compressing and shaping 0.12 g of a toner in tablets with a diameter of 13 mm under pressurizing conditions of 2000 kgf and 30 seconds and using a material obtained by fixing the resultant to a sample stage as a sample. The softening temperature is measured from the surface of the sample. A thermal probe is raised in temperature at a rate of 4° C./min and the temperature at which displacement is caused by thermal contraction is set as the softening temperature Ma of the shell layer.

In order to measure the softening temperature Mb of the core particle, toner particles are embedded using a liquid epoxy resin of Bisphenol A and a curing agent and then a cutting sample is manufactured. Then, the cutting sample is cut at −100° C. to manufacture an observation sample using a cutter with a diamond knife such as LEICA ultramicrotome (made by Hitachi High-Technologies Corporation). This sample is placed on a sample stage. The sample is observed and the softening temperature is measured for a place not containing a release agent at the center of the toner. A thermal probe is raised in temperature at a rate of 4° C./min and the temperature at which displacement is caused by thermal contraction is set as the softening temperature Mb of the core particle.

In this exemplary embodiment, it is preferable that the softening temperature Ma of the shell layer range from 70° C. to 120° C. and it is more preferable that the softening temperature Ma of the shell layer range from 75° C. to 110° C.

It is preferable that the softening temperature Mb of the core particle range from 50° C. to 100° C. and it is more preferable that the softening temperature Mb of the core particle range from 55° C. to 90° C.

Components of the toner according to this exemplary embodiment will be described below. The toner according to this exemplary embodiment includes a core particle containing an amorphous polyester resin and a colorant and a shell layer covering the core particle and containing a polystyrene resin. Inorganic particles such as silica and titania which are fluidizing agents may be added as external additives to the surface of the toner according to this exemplary embodiment.

Binder Resin

In this exemplary embodiment, an amorphous polyester resin is used as a binder resin. A crystalline resin such as a crystalline polyester resin may be used together if necessary.

Crystalline Resin

Examples of the crystalline resin used in this exemplary embodiment include a crystalline polyester resin, a polyalkylene resin, and a long-chain alkyl(meth)acrylate resin. Among these, the crystalline polyester resin may be preferably used which is excellent in low-temperature fixability of the toner by combination with the amorphous polyester resin.

From the viewpoints of storage stability and low-temperature fixability, the melting point of the crystalline polyester resin used in this exemplary embodiment preferably ranges from 50° C. to 100° C., more preferably ranges from 55° C. to 90° C., and still more preferably ranges from 60° C. to 85° C. When the melting point is higher than 50° C., deterioration in toner storage stability such as occurrence of blocking in the stored toner or degradation in fixed image storage stability after fixation may occur. When the melting point is equal to or lower than 100° C., satisfactory low-temperature fixability is obtained.

The "crystalline polyester resin" in this exemplary embodiment means a resin having a clear endothermic peak instead of a step-like endothermic amount variation through differential scanning calorimetry (hereinafter, may be abbreviated as "DSC").

The melting point of the crystalline polyester resin is measured as a peak temperature of an endothermic peak obtained through the differential scanning calorimetry (DSC).

The "crystalline polyester resin" in this exemplary embodiment includes a polymer having a structure in which the components are 100% polyester structure and a polymer (copolymer) obtained by polymerizing components of a polyester resin and other components together. In the latter, the content of the other components other than the polyester resin constituting the polymer (copolymer) is 50% by weight or less.

The crystalline polyester resin used in the toner according to this exemplary embodiment is synthesized, for example, from a polyvalent carboxylic component and a polyol component. In this exemplary embodiment, a commercially-available product or a synthetic product may be used as the crystalline polyester resin.

Examples of the polyvalent carboxylic component include aliphatic dicarboxylic acids such as an oxalic acid, a succinic acid, a glutaric acid, an adipic acid, a suberic acid, an azelaic acid, a sebacic acid, a 1,9-nonanedicarboxylic acid, a 1,10-decanedicarboxylic acid, a 1,12-dodecanedicarboxylic acid, a 1,14-tetradecanedicarboxylic acid, and a 1,18-octadecanedicarboxylic acid; aromatic dicarboxylic acids such as dibasic acids of a phthalic acid, an isophthalic acid, a terephthalic acid, a naphthalene-2,6-dicarboxylic acid, a malonic acid, a mesaconic acid, and the like; anhydrides thereof; and lower alkyl esters thereof, but the polyvalent carboxylic component is not limited to these examples.

As the polyol component, aliphatic diols can be preferably used and straight-chain aliphatic diols of which a carbon number in a main chain is in the range of from 7 to 20 may be more preferably used. When the aliphatic diol is straight-chain, the crystallinity of the polyester resin may increase and the melting temperature may be raised. When the carbon number in the main chain is equal to or more than 7, the melting temperature at the time of poly-condensation with the aromatic dicarboxylic acid may be lowered and a low temperature fixing may be easily performed. When the carbon number in the main chain is equal to or less than 20, it is easy to acquire the material in practice. The carbon number in the main chain is more preferably equal to or less than 14.

Specific examples of the aliphatic diol suitably used for synthesis of the crystalline polyester resin used in the toner according to this exemplary embodiment include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol, but the aliphaticdiol is not limited to these examples. Among these, in consideration of easy availability, 1,8-octanediol, 1,9-nonanediol, and 1,10-decanediol may be preferably used.

Examples of tri- or higher polyol include glycerin, triethylolethane, trimethylolpropane, and pentaerythritol. These examples may be used alone or in combination of two or more kinds.

The content of the aliphatic diol in the polyol component is preferably equal to or greater than 80 mol % and more preferably equal to or greater than 90 mol %. When the content of the aliphatic diol is equal to or more than 80 mol %, the crystallinity of the polyester resin increases and the melting temperature is raised, whereby toner blocking resistance and image storage stability are improved.

If necessary, a polyvalent carboxylic acid or a polyol may be added in the final stage of synthesis for the purpose of adjustment of an acid value or a hydroxyl value. Examples of the polyvalent carboxylic acid include aromatic carboxylic acids such as a terephthalic acid, an isophthalic acid, an phthalic anhydride, a trimellitic anhydride, a pyromellitic acid, and a naphthalene dicarboxylic acid; aliphatic carboxylic acids such as a maleic anhydride, a fumaric acid, a succinic acid, an alkenyl succinic anhydride, and an adipic acid; alicyclic carboxylic acids such as a cyclohexanedicarboxylic acid; and aromatic carboxylic acids having at least three carboxyl groups in a single molecule such as a 1,2,4-benzene tricarboxylic acid, a 1,2,5-benzene tricarboxylic acid, and a 1,2,4-naphthalene tricarboxylic acid.

Examples of the polyol include aliphatic diols such as ethylene glycol, diethylene glycol, triethylene glycol, propylene glycol, butane diol, hexane diol, neopentyl glycol, and glycerin; alicyclic diols such as cyclohexane diol, cyclohexane dimethanol, and hydrogenated Bisphenoal A; and aromatic diols such as ethylene oxide adduct of Bisphenol A and propylene oxide adduct of Bisphenol A.

The crystalline polyester resin is produced at a polymerization temperature of 180° C. to 230° C., and a reaction system may be depressurized, if necessary, to remove water or alcohol produced at the time of condensation.

When the polymerizable monomer is not soluble or compatible at the reaction temperature, a high-boiling-point solvent may be added and dissolved as a solubilizer. The polycondensation is performed while the solubilizer is distilled. When a polymerizable monomer having poor compatibility in the copolymerization is present, preferably, the polymerizable monomer having poor compatibility and an acid or an alcohol to be poly-condensed with the polymerizable monomer are condensed in advance and then the resultant is polycondensed with the main component.

The weight-average molecular weight (Mw) of the crystalline polyester resin is preferably in the range of from 6,000 to 35,000. When the weight-average molecular weight (Mw) is equal to or more than 6,000, the toner may not be penetrated into the surface of a recording medium such as a sheet of paper at the time of fixation to cause uneven fixation or to lower bending resistance of a fixed image. When the weight-average molecular weight (Mw) is equal to or less than 35,000, the viscosity at the time of melting is not excessively raised and the temperature for reaching the viscosity suitable for fixation is not raised, thereby achieving the low-temperature fixability.

The weight-average molecular weight is measured through the use of a gel permeation chromatography (GPC). The molecular weight measurement through the GPC is performed using GPC HLC-8120 made by Tosoh Corporation as a measuring instrument, using TSKgel Super HM-M (15 cm) made by Tosoh Corporation as a column, and using THF as a solvent. The weight-average molecular weight is calculated using a molecular weight calibration curve prepared by the use of a monodispersed polystyrene standard sample from the measurement result.

The content of the crystalline resin in the toner is preferably in the range of from 3% by weight to 40% by weight, more preferably in the range of from 4% by weight to 35% by weight, and still more preferably in the range of from 5% by weight to 30% by weight.

The crystalline resin including the crystalline polyester resin preferably includes a crystalline polyester resin (hereinafter, also referred to as a "crystalline aliphatic polyester resin") synthesized from the aliphatic polymerizable monomer as a main component (50% by weight or more). In this case, the constituent ratio of the aliphatic polymerizable monomer constituting the crystalline aliphatic polyester resin is preferably equal to or greater than 60 mol % and more preferably equal to or greater than 90 mol %. The above-mentioned aliphatic diols or dicarboxylic acids may be suitably used as the aliphatic polymerizable monomer.

Amorphous Polyester Resin

The "amorphous polyester resin" in this exemplary embodiment is a resin from which a step-like endothermic variation instead of a clear endothermic peak is obtained through the differential scanning calorimetry (DSC).

In this exemplary embodiment, since compatibility with the crystalline polyester resin is improved by using the amorphous polyester resin, the viscosity of the amorphous polyester resin is lowered with the lowering in viscosity at the melting point of the crystalline polyester and a sharp melting property (acute melting property) as a toner is obtained, which is excellent for low-temperature fixability. Since wettability with the crystalline polyester resin is superior, dispersibility of the crystalline polyester resin in the toner is improved and exposure of the crystalline polyester resin from the surface of the toner is suppressed, which is preferable from the viewpoint of improvement in resistance to cracking or chipping of the toner or improvement in strength of a fixed image.

In this exemplary embodiment, the amorphous polyester resin preferably contains an alkenyl succinic acid or an anhydride thereof as a component. By using the amorphous polyester resin containing an alkenyl succinic acid or an anhydride thereof as a component, the compatibility with the crystalline resin is improved and superior low-temperature fixability is obtained. A dodecenyl succinic acid or an octyl succinic acid is used as the alkenyl succinic acid.

The glass transition temperature (Tg) of the amorphous polyester resin is preferably in the range of from 50° C. to 80° C. When Tg is equal to or higher than 50° C., toner storage stability or fixed image storage stability is improved. When Tg is equal to or lower than 80° C., the fixation is completed at a temperature lower than that in the related art.

Accordingly, Tg of the amorphous polyester resin is more preferably in the range of from 50° C. to 65° C.

The glass transition temperature of the amorphous polyester resin is measured as a peak temperature of an endothermic peak obtained through the differential scanning calorimetry (DSC).

The content of the amorphous polyester resin in the toner is preferably in a range of from 40% by weight to 95% by weight, more preferably in a range of from 50% by weight to 90% by weight, and still more preferably in a range of from 60% by weight to 85% by weight.

The amorphous polyester resin may be produced in a way similar to the production of the crystalline polyester resin.

The weight-average molecular weight (Mw) of the amorphous polyester resin is preferably in a range of from 30,000 to 80,000. When the molecular weight (Mw) is in the range of from 30,000 to 80,000, the shape of the toner particles is controlled and a shape of potato is obtained. In addition, high-temperature offset resistance is obtained.

The weight-average molecular weight (Mw) of the amorphous polyester resin is more preferably in a range of from 35,000 to 80,000 and particularly preferably in a range of from 40,000 and 80,000.

In this exemplary embodiment, known resin materials such as epoxy resins, polyurethane resins, polyamide resins, cellulose resins, polyether resins, and polyolefin resins may be used together with the amorphous polyester resin as the binder resin.

The polystyrene resin used in this exemplary embodiment may be a styrene homopolymer or a copolymer of styrene and a vinyl monomer other than styrene.

When the polystyrene resin is a copolymer, the ratio of styrene to the overall monomers constituting the polystyrene resin is preferably in a range of from 60% by weight to 99% by weight and more preferably in a range of from 75% by weight to 99% by weight.

Examples of the vinyl monomer include a styrene-based monomer, a (meth)acrylic monomer, a vinyltoluene, a vinylcarbazole, a vinylnaphthalene, a vinylanthracene, and a 1,1-diphenyl ethylene.

Examples of the styrene-based monomer include a styrene, an alkyl-substituted styrene (such as an α-methylstyrene, a vinylnaphthalene, 2-methylstyrene, 3-methylstyrene, 4-methylstyrene, 2-ethylstyrene, 3-ethylstyrene, and 4-ethylstyrene), a halogen-substituted styrene (such as 2-chlorostyrene, 3-chlorostyrene, and 4-chlorostyrene), and a divinylbenzene.

Examples of the (meth)acrylic monomer include an acrylic acid, a methacrylic acid, and alkyl esters thereof. Examples of alkyl ester acrylate and alkyl ester methacrylate include methyl acrylate, methyl methacrylate, ethyl acrylate, ethyl methacrylate, butyl acrylate, butyl methacrylate, 2-ethylhexyl acrylate, and 2-ethylhexyl methacrylate.

Examples of a cross-linking agent which may be contained as a component of the polystyrene resin include divinylbenzene, ethylene glycol di(meth)acrylate, diethylene glycol di(meth)acrylate, methylene bis(meth)acrylamide, glycidyl (meth)acrylate, 2-([1'-methylpropylidene amino]carboxyamino) ethyl methacrylate. Among these, divinylbenzene, ethylene glycol di(meth)acrylate, and diethylene glycol di(meth)acrylate may be suitably used.

In this exemplary embodiment, the ratio of tetrahydrofuran (THF) insoluble (resin insoluble in THF) to the total content of the resin components (the amorphous polyester resin, the polystyrene resin, and other resins used together as the binder resin) is preferably in a range of from 0.1% by weight to 4.0% by weight and more preferably in a range of from 1.0% by weight to 4.0% by weight.

In order to suppress the peeling-off of a material from the surface of the toner due to a stress generated in the toner, crosslinking of the resins is effective and preferable characteristics of the toner are obtained as a result. When the resins in the toner are crosslinked, the volume change due to heat may be suppressed and thus the stress accordingly generated may be suppressed. Accordingly, the peeling-off due to the stress is suppressed when the resins on the surface of the toner is crosslinked. It is preferable that the resins on the surface of the toner be crosslinked, from the viewpoint of maintenance of the fixing temperature to be lower to a certain extent.

In this exemplary embodiment, the ratio of the THF insoluble to the total content of the resin components means a value measured through the use of the following method.

Toner particles are placed in a triangular flask, THF is added thereto, and the triangular flask is sealed and is allowed to stand for 24 hours. Thereafter, the resultant is transferred to a glass tube for centrifugal separation, THF is added again to the triangular flask and followed by cleaning, the cleaned material is transferred to a glass tube for centrifugal separation and is sealed, and centrifugal separation is performed thereon under conditions of at 20,000 rpm and −10° C. for 30 minutes. After the centrifugal separation, the resultant is taken out and is left to stand, the supernatant solution thereof is removed therefrom, and then the content of THF insoluble in the overall toner is calculated.

The proportion of the resin components in the insoluble is calculated through TGA. In measurement, by raising the temperature at a rate of 20° C./min to 600° C. in a gas flow of nitrogen, a release agent is initially volatilized and then the solid derived from the resin component is thermally decomposed. By changing the condition to an air atmosphere and continuing to raise the temperature, the remaining components derived from pigments are thermally decomposed and the remaining ash becomes the solid derived from the inorganic components. The proportion of the insoluble derived from the resin components in the insoluble content may be calculated from these proportions.

The content of the resin components in the toner itself is calculated in the same way, and the proportion of the THF insoluble to the total content of the resin components may be calculated from the ratio of the content of the resin components in the insoluble and the content of the resin components in the toner.

Colorant

The toner according to this exemplary embodiment contains a colorant.

The colorant used in this exemplary embodiment may be a dye or a pigment, but the pigment may be preferably used from the viewpoint of light resistance or water resistance.

In general, a colorant often serves as a filler for a resin and thus may have an effect of apparently raising elasticity of a resin having a lot of polar groups such as a polyester resin. Particularly, when the colorant contains an azo group, it is thought that the elasticity of the resin is raised through an interaction with an ester group of the polyester resin and the effect of the interaction is reduced at high temperatures, which is preferable.

Specific preferable examples of the pigment include, as a yellow pigment, C.I. Pigment Yellow 1, C.I. Pigment Yellow 2, C.I. Pigment Yellow 5, C.I. Pigment Yellow 6, C.I. Pigment Yellow 7, C.I. Pigment Yellow 9, C.I. Pigment Yellow 10, C.I. Pigment Yellow 11, C.I. Pigment Yellow 12, C.I. Pigment Yellow 13, C.I. Pigment Yellow 14, C.I. Pigment Yellow 15, C.I. Pigment Yellow 17, C.I. Pigment Yellow 23, C.I. Pigment Yellow 49, C.I. Pigment Yellow 55, C.I. Pigment Yellow 60, C.I. Pigment Yellow 61:1, C.I. Pigment Yellow 62, C.I. Pigment Yellow 63, C.I. Pigment Yellow 65, C.I. Pigment Yellow 73, C.I. Pigment Yellow 74, C.I. Pigment Yellow 75, C.I. Pigment Yellow 77, C.I. Pigment Yellow 83, C.I. Pigment Yellow 93, C.I. Pigment Yellow 97, C.I. Pigment Yellow 98, C.I. Pigment Yellow 101, C.I. Pigment Yellow 108, C.I. Pigment Yellow 110, C.I. Pigment Yellow 113, C.I. Pigment Yellow 115, C.I. Pigment Yellow 120, C.I. Pigment Yellow 127, C.I. Pigment Yellow 128, C.I. Pigment Yellow 138, C.I. Pigment Yellow 139, C.I. Pigment Yellow 150, C.I. Pigment Yellow 151, C.I. Pigment Yellow 154, C.I. Pigment Yellow 155, C.I. Pigment Yellow 166, C.I. Pigment Yellow 167, C.I. Pigment Yellow 168, C.I. Pigment Yellow 169, C.I. Pigment Yellow 170, C.I. Pigment Yellow 172, C.I. Pigment Yellow 180, C.I. Pigment Yellow 181, C.I. Pigment Yellow 185, and C.I. Pigment Yellow 213. Among these yellow pigments, C.I. Pigment Yellow 1, C.I. Pigment Yellow 2, C.I. Pigment Yellow 5, C.I. Pigment Yellow 6, C.I. Pigment Yellow 12, C.I. Pigment Yellow 13, C.I. Pigment Yellow 14, C.I. Pigment Yellow 15, C.I. Pigment Yellow 17, C.I. Pigment Yellow 49, C.I. Pigment Yellow 61:1, C.I. Pigment Yellow 62, C.I. Pigment Yellow 63, C.I. Pigment Yellow 65, C.I. Pigment Yellow 73, C.I. Pigment Yellow 74, C.I. Pigment Yellow 75, C.I. Pigment Yellow 83, C.I. Pigment Yellow 93, C.I. Pigment Yellow 98, C.I. Pigment Yellow 113, C.I. Pigment Yellow 120, C.I. Pigment Yellow 127, C.I. Pigment Yellow 154, C.I. Pigment Yellow 155, C.I. Pigment Yellow 166, C.I. Pigment Yellow 167, C.I. Pigment Yellow 168, C.I. Pigment Yellow 169, C.I. Pigment Yellow 170, C.I. Pigment Yellow 180, and C.I. Pigment Yellow 185 may be more preferably used, in that these pigments contain an azo group. Particularly, C.I. Pigment Yellow 17, C.I. Pigment Yellow 74, and C.I. Pigment Yellow 185 may be still more preferably used, in that the effect of the interaction is great.

Examples of an orange pigment include C.I. Pigment Orange 1, C.I. Pigment Orange 2, C.I. Pigment Orange 3, C.I. Pigment Orange 4, C.I. Pigment Orange 5, C.I. Pigment Orange 6, C.I. Pigment Orange 7, C.I. Pigment Orange 14, C.I. Pigment Orange 15, C.I. Pigment Orange 17, C.I. Pigment Orange 17:1, C.I. Pigment Orange 18, C.I. Pigment Orange 19, C.I. Pigment Orange 22, C.I. Pigment Orange 24, C.I. Pigment Orange 34, C.I. Pigment Orange 36, C.I. Pigment Orange 38, C.I. Pigment Orange 40, C.I. Pigment Orange 43, C.I. Pigment Orange 46, C.I. Pigment Orange 60, C.I. Pigment Orange 61, C.I. Pigment Orange 62, C.I. Pigment Orange 63, C.I. Pigment Orange 64, C.I. Pigment Orange 67, C.I. Pigment Orange 69, C.I. Pigment Orange 71, C.I. Pigment Orange 72, and C.I. Pigment Orange 73. Among these orange pigments, C.I. Pigment Orange 1, C.I. Pigment Orange 14, C.I. Pigment Orange 15, C.I. Pigment Orange 36, C.I. Pigment Orange 62, C.I. Pigment Orange 63, and C.I. Pigment Orange 72 may be preferably used, in that these orange pigments contain an azo group. Particularly, C.I. Pigment Orange 1, C.I. Pigment Orange 36, and C.I. Pigment Orange 72 may be still more preferably used, in that the effect of the interaction is great.

Examples of other colorants used in this exemplary embodiment include known pigments such as carbon black, aniline black, aniline blue, calcoil blue, ultramarine blue, methylene blue chloride, phthalocyanine blue, malachite green oxalate, lamp black, rose bengal, quinacridone, C.I. Pigment Blue 15:1, C.I. Pigment Blue 15:3, C.I. Pigment Red 48:1, C.I. Pigment Red 57:1, C.I. Pigment Red 122, C.I. Pigment Red 185, and C.I. Pigment Red 238.

The content of the colorant in the toner according to this exemplary embodiment is preferably in a range of from 1% by weight to 30% by weight in terms of 100% by weight of the overall resins contained in the toner. A colorant subjected to surface treatment or a pigment dispersant may be effectively used if necessary. By selecting the kinds of the colorants, a yellow toner, a magenta toner, a cyan toner, a black toner and the like are obtained.

Release Agent

The toner according to this exemplary embodiment may contain a release agent.

The release agent has appropriate compatibility with the polyester resin in addition to an operation as a fixing aid, thereby suppressing a stress generated in the toner at the time of manufacturing the toner. It is preferable that the release agent has an ester bond, from the viewpoint of further suppression of generation of a stress.

Specific examples of the release agent include low-molecular polyolefins such as polyethylene, polypropylene, and polybutene; silicones having a softening point by heating; fatty acid amides such as oleic amide, erucamide, ricinolic amide, and stearic amide; and mineral-petroleum waxes such as paraffin wax, micro-crystalline wax, and Fischer-Tropsch wax. Among these examples, ester-based waxes such as fatty acid esters, montanoic esters, and carboxylic esters may be preferably used. Carnauba wax may be more preferably used.

The content of the release agent in the toner is preferably in a range of from 0.5% by weight to 15% by weight and more preferably in a range of from 1.0% by weight to 12% by weight. When the content of the release agent is less than 0.5% by weight, peeling failure may be caused particularly in oiless fixation. When the content of the release agent is more than 15% by weight, the fluidity of the toner may degrade, thereby deteriorating image quality and reliability in image formation.

Other Additives

The toner according to this exemplary embodiment may further contain, if necessary, various components such as an internal additive, a charging-control agent, inorganic powder (inorganic particles), and organic particles in addition to the above-mentioned components.

Examples of the internal additive include metals such as ferrite, magnetite, reduced iron, cobalt, nickel, and manganese, alloys thereof, and magnetic materials such as compounds containing these metals.

The inorganic particles are added for various purposes, and may be added to adjust viscoelasticity of the toner. Glossiness of an image or penetration in paper is adjusted by this adjustment of viscoelasticity. Widely-known inorganic particles such as silica particles, titania particles, alumina particles, and particles obtained by hydrophobizing the surfaces thereof may be used alone or in combination of two or more kinds as the inorganic particles. The silica particles having a refractive index smaller than that of the binder resin may be preferably used, from the viewpoint of not damaging the coloring property or the transparency such as overhead projector (OHP) permeability. The silica particles may be subjected to various surface treatments and it is preferable to use silica particles of which the surface is treated, for example, by the use of a silane coupling agent, a titanium coupling agent, or a silicone oil.

Characteristics of Toner

The volume-average particle diameter of the toner in this exemplary embodiment is preferably in a range of from 4 μm to 9 μm, more preferably in a range of from 4.5 μm to 8.5 μm, and still more preferably in a range of from 5 μm to 8 μm. When the volume-average particle diameter is equal to or more than 4 μm, the fluidity of the toner is improved and the charging property of the particles is likely to be improved. Since the charging distribution is not spread, the blurring in background or the toner overflow from the developing device is suppressed. When the volume-average particle diameter is equal to or more than 4 μm, the degradation in cleaning property is suppressed. When the volume-average particle diameter is equal to or less than 9 μm, the resolution is improved and satisfactory image quality is obtained, thereby meeting the recent request for high image quality.

The volume-average particle diameter is measured using Coulter MULTISIZER (made by Beckman Coulter Inc.) with an aperture diameter of 50 μm. At this time, the measurement is performed after the toner is dispersed in an electrolyte solution (ISOTON solution) using ultrasonic waves for 30 seconds or more.

It is preferable that the toner according to this exemplary embodiment have a spherical shape with a shape factor SF1 of 110 to 140. When the toner have a spherical shape within this range, the transfer efficiency and the image density are improved and it is thus possible to form an image with high image quality.

It is more preferable that the shape factor SF1 is in a range of from 110 to 130.

Here, the shape factor SF1 may be calculated by Expression 1.

$$SF1=(ML^2/A)\times(m/4)\times 100 \quad (1)$$

In Expression 1, ML represents the absolute maximum length of the toner and A represents the projection area of the toner.

SF1 is digitalized by mainly analyzing a microscopic image or a scanning electron microscope (SEM) image by the use of an image analyzer and may be calculated, for example, as follows. That is, an optical microscopic image of particles scattered on a glass slide is input to an image analyzer LUZEX through the use of a video camera, the maximum length and the projection area of 100 toner particles are measured, calculation is performed using Expression 1, and the average values thereof are calculated as the shape factor SF1.

In the toner according to this exemplary embodiment, it is preferable that the storage modulus (G' (60)) at 60° C. be in a range of from $2.0\times10^5$ Pa·s to $4.0\times10^6$ Pa·s.

In general, a toner is a material having elasticity and viscosity, and it is widely known that the elasticity is indicated as a storage modulus and the viscosity is indicated as a loss modulus. The temperature in an image forming apparatus is generally higher than the outside temperature due to heat-generating devices such as a fixing device. This tendency is marked particularly at the time of continuous printing. It is thought that the storage modulus at 60° C. represents the temperature at which the toner keeps a low fixing temperature to a certain extent and is used as powders.

When (G' (60)) is in a range of from $2.0\times10^5$ Pa·s to $4.0\times10^6$ Pa·s, the low-temperature fixability and the suppression of peeling-off of the surface of the toner may be more easily compatible.

It is preferable that (G' (60)) be in a range of from $5.0\times10^6$ Pa·s to $1.0\times10^6$ Pa·s.

In this exemplary embodiment, the storage modulus is calculated from dynamic viscoelasticity measured using a sinusoidal vibration test. The dynamic viscoelasticity is measured using a measuring instrument ARES made by Rheometric Scientific Inc. In measurement of the dynamic viscoelasticity, the toner is shaped into a tablet and are then set onto a parallel plate with a diameter of 8 mm, a normal force is set to 0, and then sinusoidal vibration is given thereto at a vibration frequency of 1 rad/sec. The measurement is started at 20° C. and is continuously performed up to 100° C.

The interval of the measuring time is set to 30 seconds and the temperature-rising rate is set to 1° C./min. Before performing the measurement, stress dependency of distortion is checked with 10° C. increments at from 20° C. to 100° C., and a distortion range in which the stress and the distortion at each temperature have a linear relationship is calculated. During the measurement, the distortion at each measuring temperature is maintained within a range of from 0.01% to 0.5% and the stress and the distortion are controlled to have a linear relationship at all the temperature. The storage modulus is calculated from the measurement result.

Regarding the toner according to this exemplary embodiment, additives may be added to the toner particles after manufacturing the toner particles.

The method of manufacturing the toner particles is not particularly limited and may include, for example, a core particle dispersion preparing step of preparing a core particle dispersion in which core particles including an amorphous polyester resin and a colorant are dispersed and a seed polymerizing step of adding vinyl monomers including styrene and a polymerization initiator to the core particle dispersion and forming a shell layer including a polystyrene resin on the surfaces of the core particles through the use of a seed polymerization method.

The method of manufacturing core particles is not particularly limited and may include, for example, an aggregated particle forming process of mixing an amorphous polyester resin dispersion in which an amorphous polyester resin is dispersed, a colorant dispersion in which a colorant is dispersed, and a release agent dispersion in which a release agent is dispersed, if necessary, and forming aggregated particles including the amorphous polyester resin, the colorant, and the release agent if necessary and a coalescence process of coalescing the aggregated particles through heating to form coalesced particles. In the aggregated particle forming process, a binder resin is attached to the surfaces of the aggregated particles (attachment process) and then the coalescence process may be performed thereafter. The coalesced particles are used as core particles in the seed polymerizing process.

Emulsification Process

The resin dispersion may be prepared through emulsification by applying a shearing force to a solution in which an aqueous medium and a binder resin are mixed by the use of a disperser, in addition to a process of preparing a resin dispersion using a general polymerization method, for example, use of an emulsification polymerization method, a suspension polymerization method or dispersion polymerization method. At this time, particles may be formed by lowering the viscosity of the resin components through heating. A dispersant may be used to stabilize the dispersed resin particles. When the resin is soluble in a solvent which is oily and which has relatively low solubility in water, a resin dispersion is prepared by dissolving the resin in such a solvent, dispersing the resin particles along with a dispersant or a polymer electrolyte in water, and then transpiring the solvent through heating or depressurization.

When the resin dispersion is prepared using a polyester resin, a phase-transfer emulsification method may be used. When the resin dispersion is prepared using a binder resin other than the polyester resin, the phase-transfer emulsification method may be also used. The phase-transfer emulsification method is a method of dissolving a resin to be dispersed in a hydrophobic organic solvent in which the resin is soluble, adding a base to an organic continuous phase (O phase) for neutralization, and adding an aqueous medium (W phase) thereto, whereby the resin is converted from W/O to O/W (so-called phase-transferred) to have a discontinuous phase and the resin is dispersed in the form of particles in the aqueous medium.

Examples of the organic solvent used for the phase-transfer emulsification include alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol, and cyclohexanol, ketones such as methylethyl ketone, methylisobutyl ketone, ethylbutyl ketone, cyclohexanone, and isophorone, ethers such as tetrahydrofuran, dimethylether, diethylether, and dioxane, esters such as methyl acetate, ethyl acetate, n-propyl acetate, isopropyl acetate, n-butyl acetate, isobutyl acetate, sec-butyl acetate, 3-methoxybutyl acetate, methyl propionate, ethyl propionate, butyl propionate, dimethyl oxalate, diethyl oxalate, dimethyl succinate, diethyl succinate, dimethyl carbonate, and diethyl carbonate, glycol derivatives such as ethylene glycol, ethylene glycol monomethylether, ethylene glycol monoethylether, ethylene glycol monopropylether, ethylene glycol monobutylether, ethylene glycol ethylether acetate, diethylene glycol, diethylene glycol monomethylether, diethylene glycol monoethylether, diethylene glycol monopropylether, diethylene glycol monobutylether, diethylene glycol ethylether acetate, propylene glycol, propylene glycol monomethylether, propylene glycol monopropylether, propylene glycol monobutylether, propylene glycol methylether acetate, and dipropylene glycol monobutylether, 3-methoxy-3-methyl butanol, 3-methoxy butanol, acetonitrile, dimethylformamide, dimethylacetamide, diacetone alcohol, and ethyl acetoacetate. These solvents may be used alone or in combination of two or more kinds.

It is difficult to unconditionally determine the amount of solvent of the organic solvent used for phase-transfer emulsification, because the amount of solvent for obtaining a desired dispersed particle diameter differs depending on physical properties of the resin. However, in this embodiment, when the content of a tin compound catalyst in the resin is larger than that in a typical polyester resin, the amount of solvent with respect to the weight of the resin may be relatively large.

When a binder resin is dispersed in water, a part or all of carboxyl groups in the resin may be neutralized using a neutralizer if necessary. Examples of the neutralizer include inorganic alkalis such as potassium hydroxide and sodium hydroxide and amines such as ammonia, monomethylamine, dimethylamine, triethylamine, monoethylamine, diethylamine, mono-n-propylamine, dimethyl n-propylamine, monoethanolamine, diethanolamine, triethanolamine, N-methylethanolamine, N-aminoethylethanolamine, N-methyldiethanolamine, monoisopropanolamine, diisopropanolamine, triisopropanolamine, and N,N-dimethylpropanolamine. These neutralizers may be used alone or in combination of two or more kinds. By adding these neutralizers, pH in emulsification is adjusted to be neutral and hydrolysis of the resultant polyester resin dispersion is prevented.

The emulsification temperature in the phase-transfer emulsification has only to be equal to or lower than the boiling point of an organic solvent and be equal to or higher than the melting point or the glass transition temperature of a binder resin. When the emulsification temperature is lower than the melting temperature or the glass transition temperature of the binder resin, it is difficult to prepare the resin dispersion. When the emulsification is performed at a temperature equal to or higher than the boiling point of the organic solvent, the emulsification may be performed using a pressurized and sealed apparatus.

The content of the resin particles included in the resin dispersion is generally in a range of from 5% by weight to 50% by weight and preferably in a range of from 10% by weight to 40% by weight. When the content departs from the range, the particle size distribution of the resin particles is spread and the characteristics thereof may be deteriorated.

For example, the volume-average particle diameter of the resin particles dispersed in the resin dispersion is in a range of from 0.01 μm to 1 μm, may be preferably in a range of from 0.03 μm to 0.8 μm, and may be more preferably in a range of from 0.03 μm to 0.6 μm.

The volume-average particle diameter of the particles included in the raw material dispersion, such as resin particles, may be measured by the use of a laser-diffraction particle size distribution meter (LA-700 made by Horiba Ltd.).

Examples of the aqueous medium include waters such as distilled water and ion exchange water and alcohols. It is preferable that only water be used.

Examples of the dispersant used for the emulsification process include water-soluble polymers such as polyvinyl alcohol, methyl cellulose, ethyl cellulose, hydroxyethyl cellulose, carboxymethyl cellulose, sodium polyacrylate, and sodium polymethacrylate; surfactants such as anionic surfactants such as sodium dodecylbenzene sulfonate, sodium octadecylsulfate, sodium oleate, sodium laurate, and potassium stearate, cationic surfactants such as layrylamine acetate, stearylamine acetate, and lauryltrimethyl ammonium chloride, amphoteric surfactants such as lauryldimethylamine oxide, and nonionic surfactants such as polyoxyethylene alkylether, polyoxyethylene alkylphenylether, and polyoxyethylene alkylamine; and inorganic salts such as tricalcium phosphate, aluminum hydroxide, calcium sulfate, calcium carbonate, and barium carbonate.

Examples of the disperser used to manufacture an emulsion include a homogenizer, a homomixer, a pressurization kneader, an extruder, and a media disperser.

At the time of preparing a release agent dispersion, a release agent is dispersed along with an ionic surfactant, a polymer electrolyte such as a polyacid, or a polybase in water, and then the resultant is heated at a temperature equal to or higher than the melting point of the release agent and is subjected to a dispersing process using a homogenizer or a pressure-discharging disperser which may apply a strong shearing force. A release agent dispersion is obtained through these processes. At the time of performing the dispersing process, an inorganic compound such as polyaluminum chloride may be added to the dispersion. Preferable examples of the inorganic compound include polyaluminum chloride, aluminum sulfate, highly-basic polyaluminum chloride (BAC), polyaluminum hydroxide, and aluminum chloride. Among these examples, polyaluminum chloride and aluminum sulfate may be preferably used. The release agent dispersion is used in an emulsification aggregation method and the release agent dispersion may also be used to manufacture a toner using a suspension polymerization method.

A release agent dispersion including release agent particles with a volume-average particle diameter of 1 μm or less is obtained through the dispersing process. The volume-average particle diameter of the release agent particle is more preferably in a range of from 100 nm to 500 nm.

When the volume-average particle diameter is equal to or more than 100 nm, though it is also affected by the characteristics of the binder resin used, the release agent component is easily incorporated into the toner in general. When the volume-average particle diameter is equal to or less than 500 nm, the dispersed state of the release agent in the toner is satisfactory.

Known dispersing methods may be used to prepare the colorant dispersion and general dispersing unit may be employed such as a rotary-shearing homogenizer, a ball mill having a medium, a sand mill, a dyno mill, or an ULTIMAIZER without any particular limitation. The colorant is dispersed along with an ionic surfactant, a polymer electrolyte such as a polyacid, or a polybase in water. The volume-average particle diameter of the dispersed colorant particles has only to be equal to or less than 1 μm. When the volume-average particle diameter is in a range of from 80 nm to 500 nm, the aggregation property is not damaged and the dispersion of the colorant in the toner is excellent, which is preferable.

Aggregated Particle Forming Process

In the aggregated particle forming process, the amorphous polyester resin dispersion, the colorant dispersion, the release agent dispersion, and the like are mixed to prepare a mixed solution, and the mixed solution is heated to aggregate at a temperature equal to or lower than the glass transition temperature of the amorphous polyester resin to form aggregated particles including the amorphous polyester resin, the colorant, and the release agent. The formation of the aggregated particles is often carried out by setting pH of the mixed solution to be acidic under stirring. The pH is preferably in a range of from 2 to 7 and it is also effective to use an aggregating agent at that time.

In the aggregated particle forming process, the release agent dispersion may be added and mixed at a time along with various dispersions such as the resin dispersion, or may be added multiple times.

A divalent or higher-valent metal complex in addition to a surfactant having a polarity opposite to that of the surfactant used as the dispersant and inorganic metal salt may be suitably used as the aggregating agent. Particularly, when the metal complex is used, the amount of surfactant may be reduced and the charging characteristic may be improved, which is particularly preferable.

Particularly, an aluminum salt and a polymer thereof may be suitably used as the inorganic metal salt. In order to obtain a narrower particle size distribution, the valence of the inorganic metal salt is more preferably 2 than 1, more preferably 3 than 2, and more preferably 4 than 3, and a polymer of an inorganic metal salt of a polymerization type is more suitable when valences are the same.

In this exemplary embodiment, it is preferable that a polymer of a tetravalent inorganic metal salt containing aluminum be used, in order to obtain a narrower particle size distribution.

Attachment Process

In the attachment process, the binder resin is attached to the surfaces of the aggregated particles formed through the aggregated particle forming process (aggregated particles in which the binder resin is attached to the surfaces thereof may be referred to as "resin-attached aggregated particles").

The volume-average particle diameter of the binder resin used in the attachment process is preferably in a range of from 0.05 μm to 1 μm and more preferably in a range of from 0.08 μm to 0.5 μm.

The attachment of the binder resin to the surfaces of the aggregated particles may be performed by mixing the aggregated particle dispersion including the aggregated particles obtained through the aggregated particle forming process and the binder resin dispersion in which the binder resin is dispersed. If necessary, other components such as an aggregating agent may be added thereto.

When the resin-attached aggregated particles are heated and coalesced in the coalescence process to be described later after the binder resin is attached to the surfaces of the aggregated particles, the binder resin on the surfaces of the aggregated particles is melt and the surfaces of the aggregated particles are coated with the binder resin. Accordingly, it is possible to effectively prevent the release agent or the colorant included in the aggregated particles from being exposed from the surface of the toner.

The method of adding and mixing the binder resin dispersion in the attachment process is not particularly limited, and the adding and mixing may be slowly and continuously performed or may be performed multiple times in a stepwise manner. By adding and mixing the binder resin dispersion in this way, it is possible to suppress formation of minute particles and to make the particle size distribution of the resultant toner sharp.

In this exemplary embodiment, the number of times of performing the attachment process may be single or multiple. The aggregated particles may be coated with plural kinds of binder resins by changing the resin.

The conditions for attaching the binder resin to the aggregated particles are as follows. That is, the heating temperature in the attachment process is preferably in a temperature range of from the glass transition temperature of the amorphous polyester resin included in the aggregated particles to the glass transition temperature of the binder resin used in the attachment process.

The heating time in the attachment process depends on the heating temperature and thus may not be unconditionally determined, but is generally in a range of from 5 minutes to 2 hours.

In the attachment process, a dispersion to which a dispersion of the binder resin is added to the dispersion having the aggregated particles formed therein may be left to stand or may be slowly stirred by the use of a mixer or the like. The latter is preferable, because uniform resin-attached aggregated particles may be formed.

In the attachment process, the amount of the binder resin dispersion used depends on the particle diameter of the resin particles included therein, but is preferably selected so that the layer thickness of the finally-formed binder resin be in a range of from 20 nm to 500 nm.

Coalescence Process

In the coalescence process, under the stirring condition similar to the aggregated particle forming process, the progress of the aggregation is stopped by raising the pH of the suspension of the aggregated particles to a range of from 3 to 9, and the aggregated particles are coalesced by performing heating at a temperature equal to or higher than the glass transition temperature of the resin, whereby the aggregated particles are obtained. The heating time has only to be set so as to be coalesced and may be set to about 0.5 hour to 10 hours.

Seed Polymerizing Process

In the seed polymerizing process, vinyl monomers including styrene and a polymerization initiator are added to the dispersion of the coalesced particles (core particles) formed through the coalescence process and a shell layer including a polystyrene resin is formed on the surfaces of the core particles using a seed polymerization method. The vinyl monomers including styrene and the polymerization initiator may be added to the core particle dispersion as a polymerizable component by mixing both, or the polymerization initiator may be added after the vinyl monomers including styrene are added to the core particle dispersion, or the vinyl monomers including styrene may be added after the polymerization initiator is added to the core particle dispersion.

The polymerizable component or the vinyl monomers including styrene may be a dispersion of the components.

For example, a water-soluble polymerization initiator may be used as the polymerization initiator used in this exemplary embodiment, and examples thereof include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butylhydroperoxide pertriphenyl acetate, tert-butyl performate, tert-butyl peracetate, tert-butyl perbezoate, tert-butyl perphenylacetate, tert-butyl permethoxyacetate, N-(3-toluoyl)tert-butyl percarbamate, ammonium bisulfate, and sodium bisulfate. The polymerization initiator is not limited to these examples.

Examples of an oil-soluble polymerization initiator include azo-based polymerization initiators such as 2,2'-azobisisobutyronitrile, 2,2'-azobis(2,4-dimethylvaleronitrile), 1,1'-azobis(cyclohexane-1-carbonitrile), and 2,2'-azobis-4-methoxy-2,4-dimethylvaleronitrile.

The method of adding and mixing the polymerizable components, the vinyl monomers including styrene, or the polymerization initiator in the seed polymerizing process is not particularly limited, and the adding and mixing may be slowly and continuously performed or may be performed multiple times in a stepwise manner.

The seed polymerizing is preferably performed under conditions of a reaction temperature in a range of from 50° C. to 100° C., preferably in a range of from 60° C. to 90° C. and a reaction time in a range of from 30 minutes to 5 hours, preferably in a range of from 1 hour to 4 hours.

After the seed polymerizing process, toner particles are obtained through a solid-liquid separation process such as filtering or a washing process and a drying process if necessary.

For the purpose of adjusting charge, providing fluidity, providing charge exchangeability, and the like, inorganic oxides such as silica, titania, and alumina may be added and attached as external additives to the obtained toner particles. This addition and attachment may be performed, for example, using a V blender, a Henschel mixer, or a Loedige mixer and may be performed in a stepwise manner. The amount of external additive is preferably in a range of from 0.1 part by weight to 5 parts by weight in terms of 100 parts by weight of the toner particles, and more preferably in a range of from 0.3 part by weight to 2 parts by weight.

Coarse toner particles may be removed after external addition, using an ultrasonic sieving machine, a vibration sieving machine, a wind classifier, or the like if necessary.

Other components (particles) such as a charge-controlling agent, an organic particle, a lubricant, and an abrasive may be added in addition to the external additives.

The charge-controlling agent is not particularly limited, but colorless or light-colored agents may be preferably used. Examples thereof include complexes of a quaternary ammonium salt compound, a nigrosine compound, aluminum, iron, chromium, and the like and triphenylmethane-based pigments.

Examples of the organic particle include particles of a vinyl resin, a polyester resin, a silicone resin, and the like which are generally used as an external additive to the surface of the toner. The inorganic particle or the organic particle is used as a fluidity aid, a cleaning aid, or the like.

Examples of the lubricant include fatty acid amides such as ethylene bisstearate amide and oleic amide and fatty acid metal salts such as zinc stearate and calcium stearate.

Examples of the abrasive include silica, alumina, and ceria which are described above.

Electrostatic Charge Image Developer

An electrostatic charge image developer according to this exemplary embodiment (hereinafter, also referred to as a developer according to this exemplary embodiment) may be any one of a single-component developer including the toner according to this exemplary embodiment or a two-component developer including a carrier and the toner according to this exemplary embodiment. When the electrostatic charge image developer is used as the two-component developer, it is mixed with a carrier. The two-component developer will be described below.

The carrier which may be used in the two-component developer is not particularly limited and known carriers may be used. Examples thereof include magnetic metals such as iron oxide, nickel, and cobalt, magnetic oxides such as ferrite and magnetite, resin-coated carriers having a resin coating layer on the surface of the core material thereof, and magnetic material-dispersed carriers. Resin-dispersed carriers in which a conductive material or the like is dispersed in a matrix resin may be used.

Examples of the coating resin or the matrix resin used in the carrier include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins having an organosiloxane bond or modified products thereof, fluorine resins, polyester resins, polycarbonate resins, phenol resins, epoxy resins, (meth) acrylic resins, and dialkylaminoalkyl(meth)acrylic resins, but the coating resin or the matrix resin is not limited to these examples. Among these examples, dialkylaminoalkyl(meth) acrylic resins may be preferably used, from the viewpoint of a large amount of charge.

Examples of the conductive material include metals such as gold, silver, and copper, carbon black, titanium oxide, zinc oxide, barium sulfate, aluminum borate, potassium titanate, and tin oxide, but the conductive material is not limited to these examples.

Examples of the core material of the carrier include magnetic metals such as iron, nickel, and cobalt, magnetic oxides such as ferrite and magnetite, and glass beads. In order to use the carrier in a magnetic brush method, the core material is preferably a magnetic material. The volume-average particle diameter of the core material of the carrier is typically in the range of from 10 μm to 500 μm and preferably in the range of from 30 μm to 100 μm.

When it is intended to coat the surface of the core material of the carrier with a resin, a method of coating the surface of the core material with a coating layer forming solution in which the coating resin and various additives if necessary are dissolved in an appropriate solvent may be used. The solvent is not particularly limited, and may be appropriately selected in consideration of the coating resin used and the coating aptitude.

Specific examples of the resin coating method include a dipping method of dipping the core material of the carrier in a coating layer forming solution, a spray method of spraying a coating layer forming solution to the surface of the core material of the carrier, a fluidized bed method of spraying a coating layer forming solution to the core material of the carrier in a state where the core material is floated with fluidized air, and a kneader and coater method of mixing the core material of the carrier and a coating layer forming solution in a kneader and coater and removing the solvent.

In the two-component developer, the mixing ratio (weight ratio) of the toner according to this exemplary embodiment and the carrier is preferably in a range of 1:100 to 30:100 in terms of toner:carrier and more preferably in a range of from 3:100 to 20:100.

Image Forming Method

An image forming method according to this exemplary embodiment using the toner according to this exemplary embodiment will be described below. The image forming method according to this exemplary embodiment includes charging an electrostatic charge image holding member, forming an electrostatic charge image on a surface of the charged electrostatic charge image holding member, developing the electrostatic charge image formed on the surface of the electrostatic charge image holding member with the electrostatic charge image developer according to this exemplary embodiment to form a toner image, transferring the toner image to a transfer medium, and fixing the toner image transferred to the transfer medium.

The image forming method according to this exemplary embodiment may be performed by the use of an image forming apparatus according to this exemplary embodiment including an electrostatic charge image holding member, a charging unit that charges the electrostatic charge image holding member, an electrostatic charge image forming unit that forms an electrostatic charge image on a surface of the charged electrostatic charge image holding member, a developing unit that develops the electrostatic charge image formed on the surface of the electrostatic charge image holding member with the electrostatic charge image developer according to this exemplary embodiment to form a toner image, a transfer unit that transfers the toner image to a transfer medium, and a fixing unit that fixes the toner image transferred to the transfer medium.

The developing in this exemplary embodiment may be performed using a developing device which includes a developer holding member disposed to oppose the electrostatic charge image holding member and a transport member transporting the electrostatic charge image developer and supplying the electrostatic charge image developer to the surface of the developer holding member. In this case, the transport member may include a cylindrical shaft disposed along an axial line direction of the developer holding member and a spiral vane disposed on an outer circumferential surface of the shaft, and an interval of the vane may be set to a range of from 3 cm to 4.5 cm.

In the following description, the transport member including the cylindrical shaft and the vane may be referred to as an auger.

In the image forming apparatus, for example, a section including the developing unit may be a cartridge structure (process cartridge) that may be detachable from the image forming apparatus body. A process cartridge according to this exemplary embodiment including at least the developer holding member and housing the electrostatic charge image developer according to this exemplary embodiment may be suitably used as the process cartridge.

An example of the image forming apparatus according to this exemplary embodiment will be described below, but the invention is not limited to this example. Main parts shown in the drawings will be described and the others will not be described.

FIG. 1 is a diagram schematically illustrating the configuration of a 4-drum tandem color image forming apparatus. The image forming apparatus shown in FIG. 1 includes first to fourth image forming units 10Y, 10M, 10C, 10K (image forming unit) of an electrophotographic type outputting color images of yellow (Y), magenta (M), cyan (C), and black (K) based on color-separated image data. The image forming units (hereinafter, simply referred to as "units" in some cases) 10Y, 10M, 10C, and 10K are arranged with a predetermined distance therebetween in the horizontal direction. The units 10Y, 10M, 10C, and 10K may be process cartridges which may be attached to and detached from the image forming apparatus body.

An intermediate transfer belt 20 as an intermediate transfer member extends via the units above the units 10Y, 10M, 10C, and 10K in the drawing. The intermediate transfer belt 20 is wound on a driving roller 22 and a support roller 24 contacting the inner surface of the intermediate transfer belt 20, both of which are disposed to be separated from each other on the left and right sides in the drawing, and travels in a direction from the first unit 10Y to the fourth unit 10K. The support roller 24 is urged in the direction in which it gets away from the driving roller 22 by a spring or the like not shown and thus a tension is given to the intermediate transfer belt 20 wound on both rollers. An intermediate transfer member cleaning device 30 opposed to the driving roller 22 is disposed in the surface of the intermediate transfer belt 20 facing the image holding member.

The developing devices (developing units) 4Y, 4M, 4C, and 4K of the units 10Y, 10M, 10C, and 10K may be supplied with toners of four colors of yellow, magenta, cyan, and black contained in the toner cartridges 8Y, 8M, 8C, and 8K, respectively.

The first to fourth units 10Y, 10M, 10C, and 10K have the same configuration, and thus only the first unit 10Y for forming a yellow image disposed upstream in the traveling direction of the intermediate transfer belt will be representatively described. The same elements as the first unit 10Y are referenced by reference numerals having magenta (M), cyan (C), and black (K) added instead of yellow (Y), and the second to fourth units 10M, 10C, and 10K will not be described.

The first unit 10Y includes a photoreceptor 1Y serving as an electrostatic charge image holding member. Around the photoreceptor 1Y, a charging roller 2Y charging the surface of the photoreceptor 1Y to a predetermined potential, an exposure device (electrostatic charge image forming unit) 3 exposing the charged surface with a laser beam 3Y based on a color-separated image signal to form an electrostatic charge image, a developing device (developing unit) 4Y supplying a charged toner to the electrostatic charge image to develop the electrostatic charge image, a primary transfer roller (primary transfer unit) 5Y transferring the developed toner image onto the intermediate transfer belt 20, and a photoreceptor cleaning device (cleaning unit) 6Y removing the toner remaining on the surface of the photoreceptor 1Y after the primary transfer are arranged in this order.

The primary transfer roller 5Y is disposed inside the intermediate transfer belt 20 and is located at a position opposed to the photoreceptor 1Y. Bias sources (not shown) applying a primary transfer bias are connected to the primary transfer rollers 5Y, 5M, 5C, and 5K, respectively. The bias sources vary the transfer bias applied to the primary transfer rollers under the control of a controller not shown.

The operation of forming a yellow image in the first unit 10Y will be described below. First, before the operation, the surface of the photoreceptor 1Y is charged to a potential of about from −600 V to −800 V by the charging roller 2Y.

The photoreceptor 1Y is formed by stacking a photosensitive layer on a conductive base (with a volume resistivity of $1\times10^{-6}$ Ωcm or less at 20° C.). This photosensitive layer typically has high resistance (corresponding to the resistance of a general resin), but has a feature that the specific resistance of a section to which a laser beam is applied is changed when the laser beam 3Y is applied thereto. Here, the laser beam 3Y is emitted to the surface of the charged photoreceptor 1Y from the exposure device 3 in accordance with yellow image data sent from the controller not shown. The laser beam 3Y is applied to the photosensitive layer on the surface of the photoreceptor 1Y, whereby an electrostatic charge image of a yellow print pattern is formed on the surface of the photoreceptor 1Y.

The electrostatic charge image is an image formed on the surface of the photoreceptor 1Y by the charging, and is a so-called negative latent image which is formed by applying the laser beam 3Y to a section of the photosensitive layer to lower the specific resistance of the applied section of the photosensitive layer to cause charges to flow on the surface of the photoreceptor 1Y, while charges remain in the section to which the laser beam 3Y is not applied.

The electrostatic charge image thus formed on the photoreceptor 1Y is rotated to a predetermined developing position with the traveling of the photoreceptor 1Y. The electrostatic charge image on the photoreceptor 1Y is visualized (formed as a developed image) at the developing position by the developing device 4Y.

Figure 2:
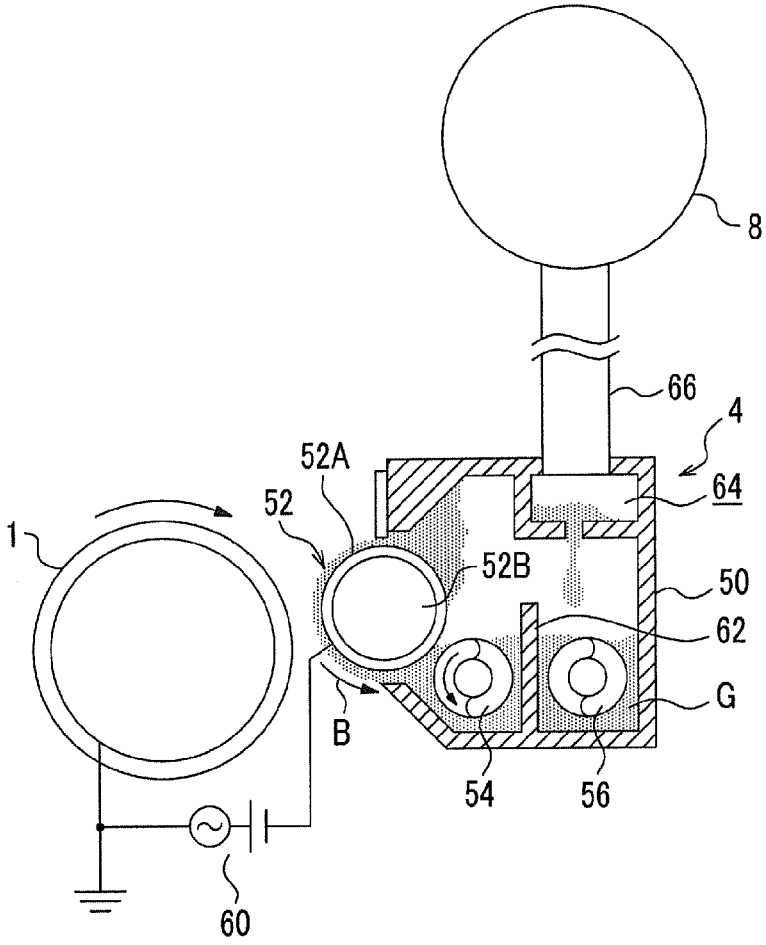
FIG. 2 is a cross-sectional view schematically illustrating an example of a developing device according to an exemplary embodiment of the invention.
Figure 3:
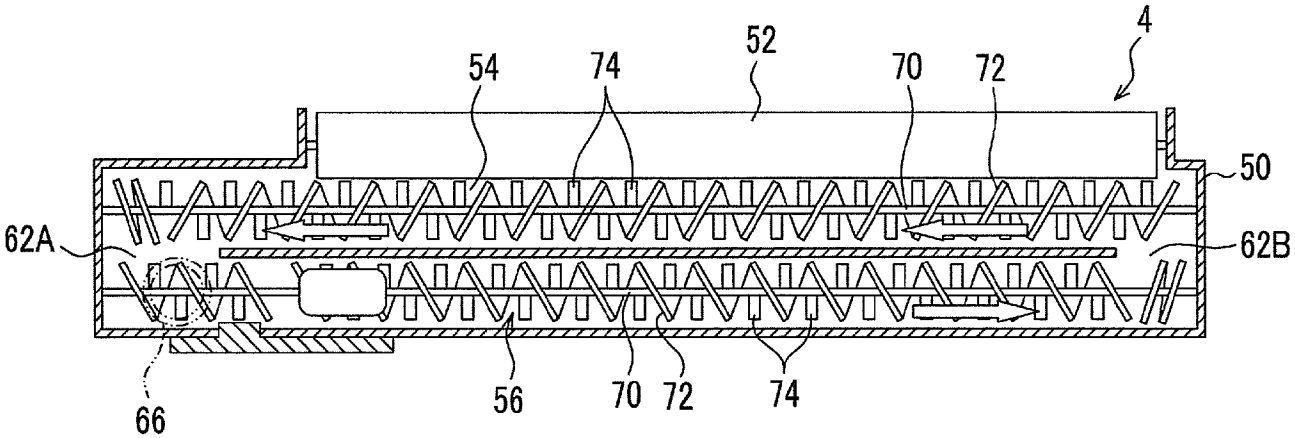
FIG. 3 is a cross-sectional view schematically illustrating an example of a developing device according to an exemplary embodiment of the invention.

The developing device 4(Y) may be, for example, a two-component type developing device performing development using a two-component developer G. As shown in FIGS. 2 and 3, in the developing device 4(Y), a developing roll 52 which is a developer holding member disposed to face the photoreceptor 1(Y) and two augers 54 and 56 agitating and transporting the two-component developer G along the axial line direction of the developing roll 52 on the lower-rear side of the developing roll 52 are disposed in a housing 50. The two-component developer G is supplied to the surface of the developing roll 52 by the auger 54.

A trimmer regulating the layer thickness of the two-component developer G transported to the developing roll 52 in a state where a magnetic brush formed thereon is disposed at a position in the upper part of the housing 50 facing the developing roll 52.

The developing roll 52 includes a cylindrical sleeve 52A formed of a nonmagnetic conductive material and a magnet roll 52B disposed in a hollow of the sleeve 52A. The magnet roll 52B is fixedly supported and the sleeve 52A is rotationally driven in the direction of arrow B by a drive source not shown. A predetermined developing bias is applied to the sleeve 52A from a developing bias power source 60. The photoreceptor 1(Y) is grounded.

As shown in FIG. 2, a partition plate 62 is disposed between the auger 54 and the auger 56 in the housing 50 in a state where passages 62A and 62B are formed at both end portions thereof. As shown in FIG. 2, an inlet portion 64 to which the toner supplied from the toner cartridge 8(Y) via a toner supply pipe 66 is once input is disposed above one end (the vicinity of the passage 62A) of the auger 56. An opening is formed in the bottom surface of the inlet portion 64 so as to supply the toner to one end of the auger 56 by an appropriate amount.

Figure 4:
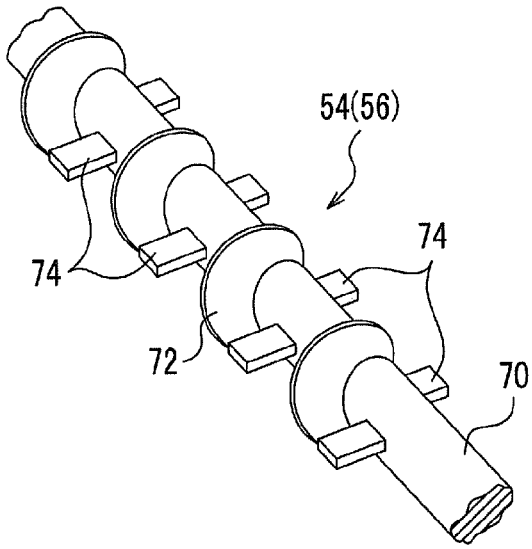
FIG. 4 is a perspective view illustrating an auger disposed in a developing device.

As shown in FIG. 4, the augers 54 and 56 each include plural spiral protrusions 72 which are blades on the outer circumferential surface of the shaft 70 which is a cylindrical shaft. A plate-shape convex portion 74 protruding from the shaft 70 is disposed between the neighboring spiral protrusions 72. The convex portions 74 are formed at positions corresponding to 0 degrees and 180 degrees in the circumferential direction of the shaft 70 in of the spaces between the spiral protrusions 72. The plates of the plural convex portions 74 are arranged to be substantially perpendicular to the axial direction of the shaft 70. The spiral protrusions 72 and the plural convex portions 74 are formed of an elastic member of which the surface may be deformed at the time of coming into contact with the developer. In this exemplary embodiment, a material such as an EPDM (Ethylene-Propylene-Diene terpolymer) rubber having superior bleed resistance is selected as a material for the elastic member. Here, Bleed means a phenomenon in which a low-molecular component in the rubber is discharged to the rubber surface and the rubbers are blocked each other or clouded. CR (chloroprene) or the like may be used as the elastic member. 30% by weight or more of a metal filler (for example, $SnO_2$, $ZnO_2$, or Al-based particles) are added to enhance the rigidity of the elastic member. By adding the metal filler, the rigidity of the spiral protrusions 72 and the convex portions 74 is raised, and the surfaces of the spiral protrusions 72 and the convex portions 74 are deformed by elasticity at the time of transporting the two-component developer G.

In this exemplary embodiment, the spiral vanes may be the spiral protrusions shown in FIGS. 3 and 4 or may be spiral vanes with a predetermined pitch in a screw shape.

As shown in FIG. 3, the auger 54 and the auger 56 are disposed so that the transport directions of the spiral protrusions 72 are opposite to each other so as to transport the two-component developer G in the opposite directions.

As shown in FIGS. 2 and 3, in the developing device 4(Y), the toner is supplied to the inlet portion 64 via the toner supply pipe 66 from the toner cartridge 8(Y) in small portions. Then, the toner is supplied to the housing 50 from the opening of the inlet portion 64. The two-component developer G in the housing 50 is cyclically transported through the passages 62A and 62B at both ends while being agitated by the rotational driving of the augers 54 and 56. At this time, the toner of the two-component developer G is frictionally charged to a predetermined polarity through mixture and agitation with the carrier. The two-component developer G agitated and transported by the auger 54 is supplied to the developing roll 52 disposed next thereto and is maintained on the surface of the developing roll 52 in a state where a magnetic brush of the two-component developer G is formed.

The magnetic brush of the two-component developer G is transported in the direction of arrow B by the rotation of the sleeve 52A. At this time, the layer thickness of the two-component developer G on the surface of the developing roll 52 is regulated to a predetermined thickness by passing through the trimmer. When the two-component developer G subjected to the layer thickness regulation is transported to a developing area facing the photoreceptor 1(Y), the toner of the two-component developer G is attached to the electrostatic charge image on the photoreceptor 1(Y) in an electrostatic manner to perform development due to a developing electric field formed by the developing bias applied to the sleeve 52A.

In this exemplary embodiment, the agitation by the auger may be slowly performed. Specifically, the interval (auger pitch) of the blades of the auger may be set to a range of from 3 cm to 4.5 cm. When the auger pitch of the auger is set to the range from 3 cm to 4.5 cm, the stress applied to the toner is reduced and occurrence of cracking or chipping of the toner is prevented.

The photoreceptor 1Y having a yellow toner image formed thereon continuously travels at a predetermined speed and the developed toner image on the photoreceptor 1Y is transported to a predetermined primary transfer position.

When the yellow toner image on the photoreceptor 1Y is transported to the primary transfer position, a primary transfer bias is applied to the primary transfer roller 5Y and an electrostatic force in the direction of from the photoreceptor 1Y to the primary transfer roller 5Y acts on the toner image, whereby the toner image on the photoreceptor 1Y is transferred to the intermediate transfer belt 20. The transfer bias applied at this time has the opposite polarity (+) of the toner polarity (−) and is controlled, for example, to about +10 μA in the first unit 10Y by a controller (not shown).

On the other hand, the toner remaining on the photoreceptor 1Y is removed and collected by the cleaning device 6Y.

The primary transfer biases applied to the primary transfer rollers 5M, 5C, and 5K of the second unit 10M and the subsequent units thereof are controlled similarly to the first unit.

In this way, the intermediate transfer belt 20 onto which the yellow toner image is transferred in the first unit 10Y is sequentially transported through the second to fourth units 10M, 10C, and 10K and the toner images of the respective colors are multiply transferred thereto in an overlap manner.

The intermediate transfer belt 20 onto which four color toner images are multiply transferred by the first to fourth units reaches a secondary transfer portion including the intermediate transfer belt 20, the support roller 24 contacting the inner surface of the intermediate transfer belt, and a secondary transfer roller (secondary transfer unit) 26 disposed on the image holding surface side of the intermediate transfer belt 20. On the other hand, a recording sheet (transfer medium) P is fed to a pressed gap between the secondary transfer roller 26 and the intermediate transfer belt 20 at a predetermined timing by a feed mechanism and a secondary transfer bias is applied to the support roller 24. The transfer bias applied at this time has the same polarity (−) as the toner polarity (−) and an electrostatic force in the direction from the intermediate transfer belt 20 to the recording sheet P acts on the toner image, whereby the toner image on the intermediate transfer belt 20 is transferred onto the recording sheet P. The secondary transfer bias at this time is determined depending on the resistance detected by a resistance detector (not shown) detecting the resistance of the secondary transfer portion and is voltage-controlled.

Thereafter, the recording sheet P is fed to a nip part between a pair of fixing rolls in the fixing device (roll-like fixing unit) 28, the toner image is heated, and the color-overlapping toner image is melted and fixed onto the recording sheet P.

Examples of the transfer medium to which a toner image is transferred include regular paper and OHP sheets used in an electrophotographic copying machine or printer.

To further improve the smoothness of the surface of a fixed image, the surface of a transfer medium is preferably as smooth as possible and, for example, a coated sheet in which the surface of a sheet of regular paper is coated with a resin or the like or a printing art sheet are suitably used.

The recording sheet P having a color image completely fixed thereto is discharged to a discharge portion and a series of color image forming operations is ended.

The above-mentioned image forming apparatus is configured to transfer a toner image to a recording sheet P via the intermediate transfer belt 20, but the image forming apparatus is not limited to this configuration and may be configured to directly transfer a toner image to a recording sheet from the photoreceptor.

Process Cartridge and Toner Cartridge

Figure 5:
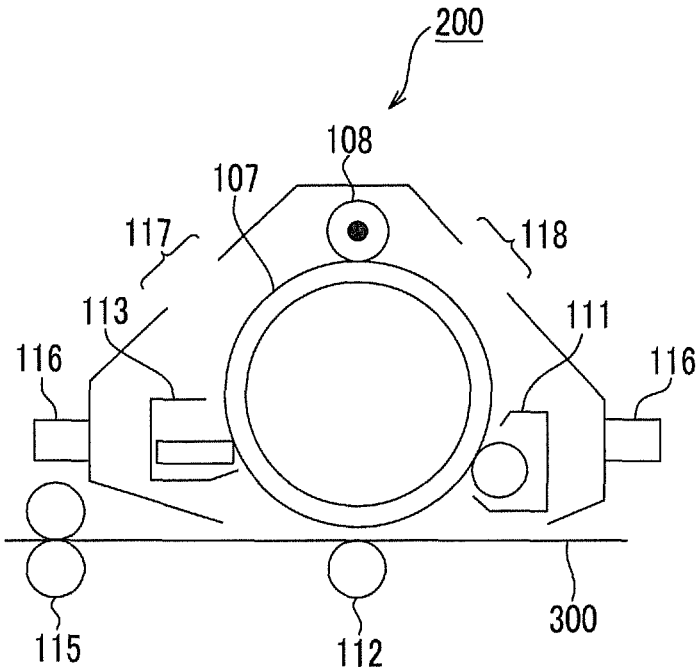
FIG. 5 is a diagram schematically illustrating an example of a configuration of a process cartridge according to an exemplary embodiment of the invention.

FIG. 5 is a diagram schematically illustrating a configuration of a preferable exemplary embodiment of a process cartridge that stores the electrostatic charge image developer according to this exemplary embodiment. In a process cartridge 200, a charging device 108, a developing device 111, a photoreceptor cleaning device 113, an exposure opening 118, and an erasing exposure opening 117 are combined with a photoreceptor 107 to form a unified body by the use of an attachment rail 116. Reference numeral 300 in FIG. 5 represents a transfer medium.

The process cartridge 200 may be mounted on and detachable from the image forming apparatus body including a transfer device 112, a fixing device 115, and other constituent parts not shown and forms the image forming apparatus along with the image forming apparatus body.

The process cartridge 200 shown in FIG. 5 includes the photoreceptor 107, the charging device 108, the developing device 111, the cleaning device 113, the exposure opening 118, and the erasing exposure opening 117, but these devices may be selectively combined. The process cartridge according to this exemplary embodiment may include at least one element selected from the group consisting of the photoreceptor 107, the charging device 108, and the cleaning device (cleaning unit) 113, the exposure opening 118, and the erasing exposure opening 117, in addition to the developing device 111.

A toner cartridge according to this exemplary embodiment will be described below. The toner cartridge according to this exemplary embodiment is detachable from the image forming apparatus and contains at least a toner to be supplied to a developing unit disposed in the image forming apparatus. Here, the above-mentioned toner according to this exemplary embodiment is used as the toner. The toner cartridge according to this exemplary embodiment has only to contain at least a toner and may contain, for example, a developer depending on the mechanism of the image forming apparatus.

Therefore, in the image forming apparatus having a structure in which the toner cartridge can be detachably mounted, the toner according to this exemplary embodiment is smoothly supplied to the developing device by using the toner cartridge containing the toner according to this exemplary embodiment.

The image forming apparatus shown in FIG. 1 is an image forming apparatus having a structure in which the toner cartridges 8Y, 8M, 8C, and 8K may be mounted thereon and demounted therefrom. The developing devices 4Y, 4M, 4C, and 4K are connected to the toner cartridges corresponding to the respective developing devices (colors) via toner supply pipes. When the toner contained in the toner cartridges runs short, the toner cartridge may be replaced.

EXAMPLES

This exemplary embodiment will be described in more detail with reference to examples, but this exemplary embodiment is not limited to the following examples.

Preparation of Resin Particle Dispersion

Preparation of Amorphous Polyester Resin Dispersion A 10 parts by mole of polyoxyethylene(2,0)-2,2-bis(4-hydroxyphenyl)propane, 90 parts by mole of polyoxypropylene (2,2)-2,2-bis(4-hydroxyphenyl)propane, 13 parts by mole of terephthalic acid, 87 parts by mole of succinic acid, and dibutyltin oxide of 0.05 parts by mole with respect to the acidic components (the total parts by mole of terephthalic acid and succinic acid) are input to a two-necked flask having been heated and dried, nitrogen gas is introduced into the flask, the inside of the flask is kept in an inert gas atmosphere and is raised in temperature, the resultant is then caused to react in a co-condensation polymerization manner at 150° C. to 230° C. for 12 hours to 20 hours, and then the inside of the flask is slowly depressurized at 210° C. to 250° C., whereby Amorphous Polyester Resin A is synthesized.

300 parts by weight of Amorphous Polyester Resin A, 1000 parts by weight of ion-exchange water, and 9 parts by weight of sodium dodecylbenzene sulfonate are input to an emulsification tank of a high-temperature and high-pressure emulsification apparatus (CAVITRON CD1010), the resultant is heated and dissolved at 130° C. and is then dispersed at 110° C. at 10,000 rpm at a flow rate of 3 L/m for 30 minutes, and the resultant is made to pass through a cooling tank, whereby Amorphous Polyester Resin Dispersion A with a solid content of 30% by weight and with a volume-average particle diameter D50v of 119 nm is prepared.

Preparation of Amorphous Polyester Resin Dispersion B

Amorphous Polyester Resin B is synthesized in the same way as preparing Amorphous Polyester Resin Dispersion A, except that the content of terephthalic acid is changed to 70 parts by mole and the content of succinic acid is changed to 8 parts by mole, whereby Amorphous Polyester Resin Dispersion B with a solid content of 30% by weight and with a volume-average particle diameter D50v of 125 nm is prepared.

Preparation of Amorphous Polyester Resin Dispersion C 80 parts by mole of bisphenol A propylene oxide adduct (NEWPOL BP-2P, made by Sanyo Chemical Industries Ltd.), 20 parts by mole of bisphenol A ethylene oxide adduct (NEWPOL BPE-20, made by Sanyo Chemical Industries Ltd.), 70 parts by mole of terephthalic acid, and 30 parts by mole of cyclohexanedicarboxylic acid are input to a reaction vessel including an agitator, a thermometer, a condenser, and a nitrogen gas introduction pipe, the inside of the reaction vessel is replaced with dry nitrogen gas, and 0.25 part by weight of tin dioctanate with respect to 100 parts by weight of the total monomer components is input thereto. The resultant is stirred to react under a nitrogen gas flow at about 180° C. for about 6 hours, then the temperature is raised to about 220° C. over 1 hour, the resultant is stirred to react for about 7.0 hours, the temperature is further raised to 235° C., the inside of the reaction vessel is depressurized to 10.0 mmHg, and the resultant is stirred to react under the depressurized atmosphere for about 2.0 hours, whereby Amorphous Polyester Resin C is synthesized.

300 parts by weight of Amorphous Polyester Resin C, 1000 parts by weight of ion-exchange water, and 9 parts by weight of sodium dodecylbenzene sulfonate are input to an emulsification tank of a high-temperature and high-pressure emulsification apparatus (CAVITRON CD1010), the resultant is heated and dissolved at 130° C. and is then dispersed at 110° C. at 10,000 rpm at a flow rate of 3 L/m for 30 minutes, and the resultant is made to pass through a cooling tank, whereby Amorphous Polyester Resin Dispersion C with a solid content of 30% by weight and with a volume-average particle diameter D50v of 145 nm is prepared.

Preparation of Crystalline Polyester Resin Dispersion

Crystalline Polyester Resin is synthesized in the same way as preparing Amorphous Polyester Resin Dispersion A, except that 50 parts by mole of 1,9-nonane diol is used, 50 parts by mole of dodecane dicarboxylate is used, and the content of dibutyl tin oxide is changed to 0.05 parts by mole, whereby Crystalline Polyester Resin with a solid content of 30% by weight and with a volume-average particle diameter D50v of 125 nm is prepared.

Preparation of Styrene-Containing Resin Dispersion 82 parts by weight of styrene, 18 parts by weight of n-butyl acrylate, 2 parts by weight of methacrylic acid, 1 part by weight of n-dodecyl mercaptan, 2 parts by weight of a nonionic surfactant (NONIPOL 400, made by Sanyo Chemical Industries Ltd.), and 3 parts by weight of an anionic surfactant (NEOGEN R, made by Dai-Ichi Kogyo Seiyaku Co., Ltd.) are dissolved in 510 parts by weight of ion-exchange water to be emulsified and polymerized in a reaction tank, and 50 parts by weight of ion-exchange water in which 4 parts by weight of ammonium persulfate is dissolved is added thereto while agitating and mixing the resultant for 20 minutes. Thereafter, the inside of the reaction tank is replaced with nitrogen and is heated to 70° C. and the emulsification polymerization is continuously performed for 5 hours. As a result, Styrene-containing Resin Dispersion with a solid content of 20% and with a volume-average particle diameter of 201 nm is obtained.

Preparation of Colorant Dispersion 1

46 parts by weight of C.I. Pigment Yellow 74 (colorant having an azo group, SEIKA FIRST YELLOW 2054, made by Dainichiseika Color & Chemicals Mfg. Co., Ltd.), 4 parts by weight of an anionic surfactant (DOWFAX, made by Dow Chemical Company), and 200 parts by weight of ion-exchange water are mixed and dissolved, the mixture is dispersed for 10 minutes by the use of a homogenizer (ULTRA-TURRAX, made by IKA Corporation), and then the resultant is dispersed using ULTIMAIZER, whereby Colorant Dispersion 1 with a volume-average particle diameter of 145 nm and a solid content of 20% by weight is obtained.

Preparation of Colorant Dispersion 2

Colorant Dispersion 2 with a volume-average particle diameter of 140 nm and a solid content of 20% by weight is prepared in the same way as preparing Colorant Dispersion 1, except that the colorant is changed to C.I. Pigment Yellow 17 (colorant having an azo group, KET YELLOW 403, made by DIC Corporation).

Preparation of Colorant Dispersion 3

Colorant Dispersion 3 with a volume-average particle diameter of 145 nm and a solid content of 20% by weight is prepared in the same way as preparing Colorant Dispersion 1, except that the colorant is changed to C.I. Pigment Yellow 185 (colorant having an azo group, PALIOTOL YELLOW d1155, made by BASF SE).

Preparation of Colorant Dispersion 4

Colorant Dispersion 4 with a volume-average particle diameter of 150 nm and a solid content of 20% by weight is prepared in the same way as preparing Colorant Dispersion 1, except that the colorant is changed to C.I. Pigment Yellow 110 (isoindolinone-based pigment, Fastogen Super Yellow, GRD, made by DIC Corporation).

Preparation of Release Agent Dispersion 1

50 parts by weight of carnauba wax (RC-160, made by TOA KASEI CO., LTD.), 1 part by weight of an anionic surfactant (NEOGEN RK, made by Dai-Ichi Kogyo Seiyaku Co., Ltd.), and 200 parts by weight of ion-exchange water are mixed and heated to 95° C., the resultant is dispersed using a homogenizer (ULTRA-TURRAX T50, made by IKA Corporation), and then the resultant is dispersed for 360 minutes using a high-pressure homogenizer Manton-Gaulin (made by Gaulin Corporation), whereby Release Agent Dispersion 1 with a volume-average particle diameter of 230 nm and a solid content of 20% by weight is obtained.

Preparation of Release Agent Dispersion 2

Release Agent Dispersion 2 with a volume-average particle diameter of 200 nm and a solid content of 20% by weight is obtained in the same way as preparing Release Agent Dispersion 1, except that cholesteryl stearate (made by Nikko Chemicals Co., Ltd.) is used instead of carnauba wax.

Preparation of Release Agent Dispersion 3

Release Agent Dispersion 3 with a volume-average particle diameter of 210 nm and a solid content of 20% by weight is obtained in the same way as preparing Release Agent Dispersion 1, except that paraffin wax (HNP-9, made by Nippon Seiro Co., Ltd.) is used instead of carnauba wax.

Example 1

Preparation of Toner Particle 1

- Amorphous Polyester Resin Dispersion A: 294 parts by weight
- Crystalline Polyester Resin Dispersion: 26 parts by weight
- Colorant Dispersion 1: 50 parts by weight
- Release Agent Dispersion 1: 50 parts by weight
- Aluminum sulfate (made by Wako Pure Chemical Industries Ltd.): 5 parts by weight
- Sodium dodecylbenzene sulfonate: 10 parts by weight 0.3 M nitric acid aqueous solution: 50 parts by weight Ion-exchange water: 500 parts by weight The above-mentioned components are input to a circular flask made of stainless tell, are dispersed using a homogenizer (ULTRA-TURRAX T50, made by IKA Corporation), and are stirred and heated to 48° C. in a heating oil bath. The temperature is kept at 48° C., it is confirmed using Coulter MULTISIZER that aggregated particles with a volume-average particle diameter of 5.3 μm are formed, 100 parts by weight of additional Amorphous Polyester Resin Dispersion A is added thereto, and this state is maintained for 30 minutes.

Then, 1 N sodium hydroxide aqueous solution is added thereto until pH reaches 7.0, and the resultant is stirred and heated to 80° C. and is maintained in this state for 3 hours. A solution in which 0.5 parts by weight of ammonium persulfate is dissolved in 10 parts by weight of ion-exchange water is added to the resultant dispersion, a mixed solution in which 18 parts by weight of styrene is mixed into 50 parts by weight of ion-exchange water at a temperature of 80° C. and 3 parts by weight of sodium dodecylbenzene sulfonate is added thereto is dropped thereon for 30 minutes, and the resultant is polymerized at 80° C. for 2 hours. The reaction product is filtered, is washed with ion-exchange water, and is then dried using a vacuum dryer, whereby Toner Particle 1 is obtained.

Production of Toner 1

1.5 parts by weight of hydrophobic silica (TS720, made by Cabot Japan K.K.) is added to 50 parts by weight of Toner Particle 1 obtained as described above, and the resultant is mixed at a circumferential speed of 30 m/s for 3 minutes using a Henschel mixer, whereby Toner 1 which is an externally-added toner is obtained.

Production of Developer 1

100 parts by weight of ferrite particles (with an average particle diameter of 50 μm, made by Powder Tech Co., Ltd.) and 1.5 parts by weight of a methyl polymethacrylate resin (with a molecular weight of 95,000 in which the ratio of components with a molecular weight less than 10,000 is 5%, made by Mitsubishi Rayon Co., Ltd.) are input to a pressurizing kneader along with 500 parts by weight of toluene, the resultant is stirred and mixed at the room temperature (25° C.) for 15 minutes, the temperature is raised to 70° C. to distill toluene while depressurizing and mixing the resultant, and the resultant is then cooled and classified using a 105 μm sieve, whereby a resin-coated ferrite carrier is obtained.

The resin-coated ferrite carrier and Toner 1 which is the above-mentioned externally-added toner are mixed to produce two-component Developer 1 with a toner concentration of 7% by weight.

Evaluation

Evaluation of Toner Particle Size Distribution and Image Quality

By using a modified machine (of which the auger in a developing device is replaced with an auger with a vane interval, that is, an auger pitch of 3.2 cm) of DocuCentre Color400 made by Fuji Xerox Co., Ltd., the developing device is idly driven for 240 minutes under a high-temperature and high-humidity (32° C./85% RH) environment and then the developer in the developing device is taken out. The volume-average particle diameter (D1) of the toner before the idle driving and the volume-average particle diameter (D2) after the idle driving are measured using the Coulter MULTISIZER, and presence of chipping or cracking of the toner is evaluated. The evaluation criteria are described below. An image printing operation is performed, and fogging of a non-image part and unevenness in image density in the first sheet and the tenth sheet are checked. Regarding the image, Test Chart No. 1-R issued by the Imaging Society of Japan is used.

The fogging of the non-image part is based on the possibility that particles having a small amount of charge may be formed due to chipping and cracking of the toner. The unevenness in image density is based on the possibility that the amount of toner to be used for development may be reduced due to formation of particles having an excessive amount of charge. Both may occur even when D1-D2 is less than 0.05 μm. Therefore, images using toners of which D1-D2 is equal to or more than 0.05 μm are not evaluated.

The results are shown in Table 1.

G7: D1-D2 is less than 0.05 μm, and fogging of a non-image part and unevenness in image density is not observed.

G6: D1-D2 is less than 0.05 μm, and fogging of a non-image part and unevenness in image density are not observed, but fogging on a photoreceptor is observed.

G5: D1-D2 is less than 0.05 μm, and fogging of a non-image part and unevenness in image density are not observed with a naked eye, but is slightly observed with a magnifying glass.

G4: D1-D2 is less than 0.05 μm, and fogging of a non-image part and unevenness in image density are slightly observed with a naked eye.

G3: D1-D2 is less than 0.05 μm, and fogging of a non-image part and unevenness in image density are slightly observed with a naked eye, but are allowable.

G2: D1-D2 is equal to or more than 0.05 μm and less than 0.1 μm, and minor cracking and chipping are recognized, but there is no problem in practice.

G1: D1-D2 is equal to or more than 0.1 μm and cracking and chipping are recognized.

Samples evaluated to be equal to or higher than G2 under the condition of an auger pitch of 3.2 cm are evaluated in the same way with the auger pitches changed to 4.4 cm, 4.6 cm, and 2.8 cm. The evaluation to be equal to or higher than G2 is allowable.

Example 2

Toner Particle 2 is obtained in the same way as in Example 1, except that the amount of styrene is changed to 14 parts by weight at the time of preparation of the toner particles, and evaluation is performed thereon in the same way. The results are shown in Table 1.

Example 3

Toner Particle 3 is obtained in the same way as in Example 1, except that the amount of styrene is changed to 22 parts by weight at the time of preparation of the toner particles, and evaluation is performed thereon in the same way. The results are shown in Table 1.

Example 4

Toner Particle 4 is obtained in the same way as in Example 1, except that the amount of styrene is changed to 10 parts by weight at the time of preparation of the toner particles, and evaluation is performed thereon in the same way. The results are shown in Table 1.

Example 5

Toner Particle 5 is obtained in the same way as in Example 1, except that the amount of styrene is changed to 30 parts by weight at the time of preparation of the toner particles, and evaluation is performed thereon in the same way. The results are shown in Table 1.

Example 6

Toner Particle 6 is obtained in the same way as in Example 1, except that the amount of styrene is changed to 32 parts by weight at the time of preparation of the toner particles, and evaluation is performed thereon in the same way. The results are shown in Table 1.

Example 7

Toner Particle 7 is obtained in the same way as in Example 1, except that the amount of styrene is changed to 38 parts by weight at the time of preparation of the toner particles, and evaluation is performed thereon in the same way. The results are shown in Table 1.

Comparative Example 1

Toner Particle 8 is obtained in the same way as in Example 1, except that the amount of styrene is changed to 8 parts by weight at the time of preparation of the toner particles, and evaluation is performed thereon in the same way. The results are shown in Table 2.

Comparative Example 2

Toner Particle 9 is obtained in the same way as in Example 1, except that the amount of styrene is changed to 40 parts by weight at the time of preparation of the toner particles, and evaluation is performed thereon in the same way. The results are shown in Table 2.

Example 8

Toner Particle 10 is obtained in the same way as in Example 1, except that Amorphous Polyester Resin Dispersion A is replaced with Amorphous Polyester Resin Dispersion B at the time of preparation of the toner particles, and evaluation is performed thereon in the same way. The results are shown in Table 1.

Example 9

Toner Particle 11 is obtained in the same way as in Example 8, except that the amount of styrene is changed to 16 parts by weight at the time of preparation of the toner particles, and evaluation is performed thereon in the same way. The results are shown in Table 1.

Example 10

Toner Particle 12 is obtained in the same way as in Example 8, except that the amount of styrene is changed to 20 parts by weight at the time of preparation of the toner particles, and evaluation is performed thereon in the same way. The results are shown in Table 1.

Example 11

Toner Particle 13 is obtained in the same way as in Example 8, except that the amount of styrene is changed to 12 parts by weight at the time of preparation of the toner particles, and evaluation is performed thereon in the same way. The results are shown in Table 1.

Example 12

Toner Particle 14 is obtained in the same way as in Example 8, except that the amount of styrene is changed to 36 parts by weight at the time of preparation of the toner particles, and evaluation is performed thereon in the same way. The results are shown in Table 1.

Example 13

Toner Particle 15 is obtained in the same way as in Example 8, except that the amount of styrene is changed to 38 parts by weight at the time of preparation of the toner particles, and evaluation is performed thereon in the same way. The results are shown in Table 1.

Comparative Example 3

Toner Particle 16 is obtained in the same way as in Example 8, except that the amount of styrene is changed to 10 parts by weight at the time of preparation of the toner particles, and evaluation is performed thereon in the same way. The results are shown in Table 2.

Example 14

Toner Particle 17 is obtained in the same way as in Example 1, except that Amorphous Polyester Resin Dispersion A is replaced with Amorphous Polyester Resin Dispersion C at the time of preparation of the toner particles, and evaluation is performed thereon in the same way. The results are shown in Table 1.

Example 15

Toner Particle 18 is obtained in the same way as in Example 14, except that the amount of styrene is changed to 20 parts by weight at the time of preparation of the toner particles, and evaluation is performed thereon in the same way. The results are shown in Table 1.

Example 16

Toner Particle 19 is obtained in the same way as in Example 14, except that the amount of styrene is changed to 22 parts by weight at the time of preparation of the toner particles, and evaluation is performed thereon in the same way. The results are shown in Table 1.

Example 17

Toner Particle 20 is obtained in the same way as in Example 14, except that the amount of styrene is changed to 24 parts by weight at the time of preparation of the toner particles, and evaluation is performed thereon in the same way. The results are shown in Table 1.

Example 18

Toner Particle 21 is obtained in the same way as in Example 14, except that the amount of styrene is changed to 10 parts by weight at the time of preparation of the toner particles, and evaluation is performed thereon in the same way. The results are shown in Table 1.

Example 19

Toner Particle 22 is obtained in the same way as in Example 14, except that the amount of styrene is changed to 8 parts by weight at the time of preparation of the toner particles, and evaluation is performed thereon in the same way. The results are shown in Table 1.

Comparative Example 4

Toner Particle 23 is obtained in the same way as in Example 14, except that the amount of styrene is changed to 6 parts by weight at the time of preparation of the toner particles, and evaluation is performed thereon in the same way. The results are shown in Table 2.

Example 20

Toner Particle 24 is obtained in the same way as in Example 14, except that the amount of styrene is changed to 28 parts by weight at the time of preparation of the toner particles, and evaluation is performed thereon in the same way. The results are shown in Table 1.

Comparative Example 5

Toner Particle 25 is obtained in the same way as in Example 14, except that the amount of styrene is changed to 30 parts by weight at the time of preparation of the toner particles, and evaluation is performed thereon in the same way. The results are shown in Table 2.

Example 21

Toner Particle 26 is obtained in the same way as in Example 1, except that Colorant Dispersion 1 is replaced with Colorant Dispersion 2 at the time of preparation of the toner particles, and evaluation is performed thereon in the same way. The results are shown in Table 1.

Example 22

Toner Particle 27 is obtained in the same way as in Example 1, except that Colorant Dispersion 1 is replaced with Colorant Dispersion 3 at the time of preparation of the toner particles, and evaluation is performed thereon in the same way. The results are shown in Table 1.

Example 23

Toner Particle 28 is obtained in the same way as in Example 1, except that Colorant Dispersion 1 is replaced with Colorant Dispersion 4 at the time of preparation of the toner particles, and evaluation is performed thereon in the same way. The results are shown in Table 1.

Example 24

Toner Particle 29 is obtained in the same way as in Example 1, except that Release Agent Dispersion 1 is replaced with Release Agent Dispersion 2 at the time of preparation of the toner particles, and evaluation is performed thereon in the same way. The results are shown in Table 1.

Example 25

Toner Particle 30 is obtained in the same way as in Example 1, except that Release Agent Dispersion 1 is replaced with Release Agent Dispersion 3 at the time of preparation of the toner particles, and evaluation is performed thereon in the same way. The results are shown in Table 1.

Example 26

Toner Particle 31 is obtained in the same way as in Example 1, except that the amount of Amorphous Polyester Resin Dispersion A is changed to 320 parts by weight and Crystalline Polyester Resin Dispersion is not added at the time of preparation of the toner particles, and evaluation is performed thereon in the same way. The results are shown in Table 1.

Example 27

162 parts by weight of Amorphous Polyester Resin A, 11 parts by weight of Crystalline Polyester Resin, 14 parts by weight of C.I. Pigment Yellow 74 (SEIKA FIRST YELLOW 2054, made by Dainichiseika Color & Chemicals Mfg. Co., Ltd.), and 14 parts by weight of carnauba wax (RC-160, made by TOA KASEI CO., LTD.) are input to a Banbury mixer (made by KOBE STEEL LTD.), the inside is pressurized so that the internal temperature reaches 110±5° C., and the mixture is kneaded at 80 rpm for 10 minutes. The kneaded material is cooled, is coarsely pulverized with a hammer mill, and is finely pulverized with a jet mill, and the resultant particles are classified with an elbow-jet air classifier (made by MATSUZAKA BOEKI KK). 100 parts by weight of the resultant particles are dispersed in an aqueous solution in which 6.8 parts by weight of sodium dodecylbenzene sulfonate is added to 550 parts by weight of ion-exchange water, whereby a dispersion is prepared. A solution in which 0.34 parts by weight of ammonium persulfate is dissolved in 10 parts by weight of ion-exchange water is added to the resultant dispersion, a mixed solution in which 12.3 parts by weight of styrene is mixed into 34 parts by weight of ion-exchange water at a temperature of 80° C. and 2 parts by weight of sodium dodecylbenzene sulfonate is added thereto is dropped thereon over 30 minutes, and the resultant is polymerized at 80° C. for 2 hours. The reaction product is filtered, is washed with ion-exchange water, and is then dried using a vacuum dryer to obtain Toner Particle 32, and the same evaluation is performed thereon. The result is shown in Table 1.

Comparative Example 6

Toner Particle 33 is obtained in the same way as preparing Toner Particle 1, except that the adding (dropping) of styrene, ammonium persulfate, and ion-exchange water performed at the time of preparation of Toner Particle 1 is not performed, and evaluation is performed thereon in the same way. The results are shown in Table 2.

Comparative Example 7

Toner Particle 34 is obtained in the same way as preparing Toner Particle 1, except that 100 parts by weight of the additional Amorphous Polyester Resin Dispersion A is changed to 100 parts by weight of Styrene-containing Resin Dispersion, and the adding (dropping) of styrene, ammonium persulfate, and ion-exchange water is not performed at the time of preparation of the toner particles, and evaluation is performed thereon in the same way. The results are shown in Table 2.

TABLE 1

| | | Ma (° C.) | Mb (° C.) | Ma − Mb (° C.) | G' (60) ($\times 10^5$ Pa) | THF insoluble (%) | Evaluation: Auger pitch 3.2 cm | Auger pitch 4.4 cm | Auger pitch 4.6 cm | Auger pitch 2.8 cm |
|---|---|---|---|---|---|---|---|---|---|---|
| Ex. 1 | Toner Particle 1 | 89 | 68 | 21 | 6.2 | 1.9 | G7 | G7 | G6 | G6 |
| Ex. 2 | Toner Particle 2 | 84 | 68 | 16 | 4.4 | 1.4 | G6 | G6 | G5 | G5 |
| Ex. 3 | Toner Particle 3 | 93 | 68 | 25 | 8.6 | 2.3 | G7 | G7 | G6 | G6 |
| Ex. 4 | Toner Particle 4 | 80 | 68 | 12 | 3.2 | 1 | G5 | G5 | G4 | G4 |
| Ex. 5 | Toner Particle 5 | 102 | 68 | 34 | 16.5 | 3.2 | G6 | G6 | G5 | G5 |
| Ex. 6 | Toner Particle 6 | 104 | 67 | 37 | 19.5 | 3.4 | G5 | G5 | G4 | G4 |
| Ex. 7 | Toner Particle 7 | 111 | 67 | 44 | 32 | 4.1 | G3 | G3 | G2 | G2 |
| Ex. 8 | Toner Particle 10 | 89 | 74 | 15 | 8.7 | 1.9 | G7 | G7 | G6 | G6 |
| Ex. 9 | Toner Particle 11 | 87 | 74 | 13 | 7.4 | 1.7 | G6 | G6 | G5 | G5 |
| Ex. 10 | Toner Particle 12 | 91 | 74 | 17 | 10.3 | 2.1 | G6 | G6 | G5 | G5 |
| Ex. 11 | Toner Particle 13 | 82 | 72 | 10 | 5.3 | 1.2 | G6 | G6 | G5 | G5 |
| Ex. 12 | Toner Particle 14 | 108 | 79 | 29 | 38.4 | 3.9 | G6 | G6 | G5 | G5 |
| Ex. 13 | Toner Particle 15 | 111 | 79 | 32 | 45.2 | 4.1 | G3 | G3 | G2 | G2 |
| Ex. 14 | Toner Particle 17 | 89 | 60 | 29 | 1.8 | 1.9 | G5 | G5 | G4 | G4 |
| Ex. 15 | Toner Particle 18 | 91 | 59 | 32 | 2.1 | 2.1 | G6 | G6 | G5 | G5 |
| Ex. 16 | Toner Particle 19 | 93 | 58 | 35 | 2.4 | 2.3 | G6 | G6 | G5 | G5 |
| Ex. 17 | Toner Particle 20 | 95 | 57 | 38 | 2.9 | 2.6 | G5 | G5 | G4 | G4 |
| Ex. 18 | Toner Particle 21 | 80 | 64 | 16 | 0.91 | 1 | G5 | G5 | G4 | G4 |
| Ex. 19 | Toner Particle 22 | 78 | 65 | 13 | 0.77 | 0.8 | G4 | G4 | G3 | G3 |
| Ex. 20 | Toner Particle 24 | 100 | 55 | 45 | 4 | 3 | G5 | G5 | G4 | G4 |
| Ex. 21 | Toner Particle 26 | 89 | 68 | 21 | 6.2 | 1.9 | G7 | G7 | G6 | G6 |
| Ex. 22 | Toner Particle 27 | 88 | 68 | 20 | 6.2 | 1.9 | G7 | G7 | G6 | G6 |
| Ex. 23 | Toner Particle 28 | 89 | 67 | 22 | 6.2 | 1.9 | G6 | G6 | G5 | G5 |
| Ex. 24 | Toner Particle 29 | 89 | 65 | 24 | 6.2 | 1.9 | G6 | G6 | G5 | G5 |
| Ex. 25 | Toner Particle 30 | 89 | 70 | 19 | 6.2 | 1.9 | G5 | G5 | G4 | G4 |
| Ex. 26 | Toner Particle 31 | 89 | 69 | 20 | 6.2 | 1.9 | G6 | G6 | G5 | G5 |
| Ex. 27 | Toner Particle 32 | 90 | 64 | 26 | 5.4 | 1.6 | G6 | G6 | G5 | G5 |

TABLE 2

| | | Ma (° C.) | Mb (° C.) | Ma − Mb (° C.) | G' (60) ($\times 10^5$ Pa) | THF insoluble (%) | Evaluation: Auger pitch 3.2 cm | Auger pitch 4.4 cm | Auger pitch 4.6 cm | Auger pitch 2.8 cm |
|---|---|---|---|---|---|---|---|---|---|---|
| Com. Ex. 1 | Toner Particle 8 | 78 | 69 | 9 | 2.7 | 0.8 | G1 | — | — | — |
| Com. Ex. 2 | Toner Particle 9 | 113 | 67 | 46 | 37.7 | 4.3 | G1 | — | — | — |
| Com. Ex. 3 | Toner Particle 16 | 80 | 72 | 8 | 4.5 | 1 | G1 | — | — | — |
| Com. Ex. 4 | Toner Particle 23 | 75 | 66 | 9 | 0.65 | 0.5 | G1 | — | — | — |
| Com. Ex. 5 | Toner Particle 25 | 102 | 54 | 48 | 4.7 | 3.2 | G1 | — | — | — |
| Com. Ex. 6 | Toner Particle 33 | 69 | 68 | 1 | 1.5 | 0 | G1 | — | — | — |
| Com. Ex. 7 | Toner Particle 34 | 84 | 76 | 8 | 2.1 | 0 | G1 | — | — | — |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a core particle that contains an amorphous polyester resin and a colorant; and a shell layer that covers the core particle and contains a polystyrene resin, wherein a softening temperature Ma of the shell layer and a softening temperature Mb of the core particle satisfy a relationship of 10° C.≤Ma-Mb≤45° C., wherein a ratio of a tetrahydrofuran insoluble to the total content of a resin component ranges from 0.1% by weight to 4.0% by weight, and wherein the colorant includes at least one selected from the group consisting of C.I. Pigment Yellow 17, C.I. Pigment Yellow 74, and C.I. Pigment Yellow 185.

2. The electrostatic charge image developing toner according to claim 1, wherein a storage modulus (G'(60)) at 60° C. is in a range of from $2.0\times10^5$ Pa·s to $4.0\times10^6$ Pa·s.

3. The electrostatic charge image developing toner according to claim 1, wherein the colorant has an azo group.

4. The electrostatic charge image developing toner according to claim 1, further comprising a release agent having an ester bond.

5. The electrostatic charge image developing toner according to claim 4, wherein the release agent is a carnauba wax.

6. The electrostatic charge image developing toner according to claim 1, wherein the polyester resin is selected from a styrene homopolymer and a copolymer of styrene and a vinyl monomer other than styrene.

7. The electrostatic charge image developing toner according to claim 6, wherein a ratio of styrene in the copolymer of styrene and a vinyl monomer other than styrene is in a range of from 60% by weight to 99% by weight.

8. A method of manufacturing the electrostatic charge image developing toner according to claim 1, comprising:

preparing a core particle dispersion in which core particles containing an amorphous polyester resin and a colorant are dispersed; and adding a vinyl monomer containing styrene and a polymerization initiator to the core particle dispersion and forming a shell layer containing a polystyrene resin on surfaces of the core particles through the use of a seed polymerization method.

9. An electrostatic charge image developer comprising an electrostatic charge image developing toner according to claim 1.

10. A toner cartridge comprising a toner containing chamber, wherein an electrostatic charge image developing toner according to claim 1 is contained in the toner containing chamber.

11. A process cartridge that is detachable from an image forming apparatus, comprising:

a developer holding member; and a developer containing chamber, wherein the developer containing chamber contains an electrostatic charge image developer according to claim 9.

12. An image forming method comprising:

charging an electrostatic charge image holding member;

forming an electrostatic charge image on a surface of a charged electrostatic charge image holding member;

developing the electrostatic charge image formed on the surface of the electrostatic charge image holding member with an electrostatic charge image developer according to claim 9 to form a toner image;

transferring the toner image to a transfer medium; and fixing the toner image transferred to the transfer medium.

13. The image forming method according to claim 12, wherein the developing of the electrostatic charge image is performed using a developing device which includes a developer holding member disposed to oppose the electrostatic charge image holding member and a transport member transporting the electrostatic charge image developer and supplying the electrostatic charge image developer on the surface of the developer holding member, and wherein the transport member includes a cylindrical shaft disposed along an axial line direction of the developer holding member and a spiral vane disposed on an outer circumferential surface of the shaft, and an interval of the vane ranges from 3 cm to 4.5 cm.

* * * * *